US010648137B1

(12) United States Patent
Hurley

(10) Patent No.: US 10,648,137 B1
(45) Date of Patent: May 12, 2020

(54) LAND DRAINAGE VACUUM LIFT SYSTEM AND METHOD

(71) Applicant: Dennis Hurley, Marrero, LA (US)

(72) Inventor: Dennis Hurley, Marrero, LA (US)

( * ) Notice: Subject to any disclaimer, the term of this patent is extended or adjusted under 35 U.S.C. 154(b) by 0 days.

(21) Appl. No.: 16/249,770

(22) Filed: Jan. 16, 2019

Related U.S. Application Data

(60) Provisional application No. 62/617,917, filed on Jan. 16, 2018.

(51) Int. Cl.
*E01C 13/08* (2006.01)
*E01C 13/02* (2006.01)

(52) U.S. Cl.
CPC ..... *E01C 13/083* (2013.01); *E01C 13/02* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,345,655 | A | 7/1920 | Wood | |
| 3,788,544 | A | 1/1974 | Koskinenm | |
| 3,908,385 | A | 9/1975 | Daniel et al. | |
| 4,260,283 | A * | 4/1981 | Croy | E02D 19/10 405/36 |
| 4,348,135 | A | 9/1982 | St. Clair | |
| 4,704,047 | A | 11/1987 | Oldfelt et al. | |
| 4,717,284 | A | 1/1988 | Gress | |
| 4,919,568 | A | 4/1990 | Hurley | |
| 4,927,292 | A | 5/1990 | Justice | |
| 4,988,235 | A | 1/1991 | Hurley | |
| 5,120,157 | A | 6/1992 | Todd, Sr. et al. | |
| 5,219,243 | A | 6/1993 | McCoy | |
| 5,350,251 | A | 9/1994 | Daniel | |
| 5,590,980 | A | 1/1997 | Daniel | |
| 5,752,784 | A | 5/1998 | Motz et al. | |
| 5,848,856 | A | 12/1998 | Bohnhoff | |
| 5,944,444 | A | 8/1999 | Motz et al. | |
| 6,095,718 | A | 8/2000 | Bohnhoff | |

(Continued)

FOREIGN PATENT DOCUMENTS

| | | |
|---|---|---|
| CN | 103628466 | 3/2014 |
| CN | 103790833 | 5/2014 |

(Continued)

OTHER PUBLICATIONS

"An Automated Vacuum Extraction Control System for Soil Water Percolation Samplers", R. D. Lentz and D.C. Kincaid, Soil Sci. Soc. Am. J., vol. 67, 100-106 (2003).

(Continued)

*Primary Examiner* — Kyle Armstrong
(74) *Attorney, Agent, or Firm* — Garvey, Smith & Nehrbass, Patent Attorneys, L.L.C.; Julia M. FitzPatrick; Gregory C. Smith

(57) ABSTRACT

A land drainage apparatus, system, and method utilize a vacuum pump and atmospheric pressure to lift water from a collection basin to a level above a fluid intake level. After a certain amount of water is lifted and collected in a second chamber above the level of the collection basin, the vacuum can be broken, enabling the water to flow out of the second chamber by gravity flow to an exit, wherein the exit is above the fluid level intake and below the second chamber.

21 Claims, 11 Drawing Sheets

(56) References Cited

U.S. PATENT DOCUMENTS

| | | | | |
|---|---|---|---|---|
| 6,712,553 | B1 * | 3/2004 | Niedermeyer | E02D 31/02 405/41 |
| 6,990,993 | B2 | 1/2006 | Hafner et al. | |
| 7,172,366 | B1 | 2/2007 | Bishop, Jr. | |
| 7,413,380 | B2 | 8/2008 | Corwon et al. | |
| 2005/0186030 | A1 * | 8/2005 | Peters | B65G 5/005 405/53 |
| 2009/0056418 | A1 | 3/2009 | Cole et al. | |

FOREIGN PATENT DOCUMENTS

| | | |
|---|---|---|
| JP | H07150616 A | 6/1995 |
| WO | 9204823 | 4/1992 |
| WO | 9625034 | 8/1996 |

OTHER PUBLICATIONS

"Vacuum Consolidation Method—Worldwide Practice and the Latest Improvement in Japan", Loan T.K.Dam, Isamu Sandanbata, Makoto Kimura (Dec. 2006).
Hydrobull No. 120—Golf Course Irrigation Pump Stations (Nov. 27, 2009).
"Water lifting devices", Natural Resources Management and Environment Department (downloaded Dec. 12, 2017).
"Q-VAC—High Quality Vacuum Priming Systems, Siphon Control Systems, Water Box Priming" (downloaded Dec. 14, 2017).
"Vacuum Priming Systems for Suction Lift Stations", Propump and Controls, Inc. (downloaded Dec. 14, 2017).
"Field Draiinage Pumping Systems", Carry Pumps/Controls (downloaded on Dec. 19, 2017).

* cited by examiner

LAND DRAINAGE VACUUM LIFT SYSTEM AND METHOD

CROSS-REFERENCE TO RELATED APPLICATIONS

This application claims the benefit of U.S. Provisional Patent Application Ser. No. 62/617,917, filed on 16 Jan. 2018, which is hereby incorporated herein by reference and priority to/of which is hereby claimed.

STATEMENT REGARDING FEDERALLY SPONSORED RESEARCH OR DEVELOPMENT

Not Applicable

REFERENCE TO A "MICROFICHE APPENDIX"

Not Applicable

FIELD OF THE INVENTION

The present invention relates to drainage for land areas. More particularly, the present invention relates to an apparatus, system and method for draining land areas, such as golf courses, farms, highways, and/or homes or residential areas through the collection of drainage or seepage water into a principal catch basin positioned underground and lifting or pumping the collected water out through use of a vacuum pump or regenerative blower. A vacuum pump or regenerative blower is utilized to create a vacuum in tubing that is in fluid communication with the catch basin, creating a rise in the water column through the force of atmospheric pressure that draws water out of the catch basin and upwards. Level controls, e.g., a switch, can be used to determine when the system should be activated and deactivated, and also when to break the vacuum when piping is full of water. When the vacuum is broken, the water can then drain by gravity flow to a location that is at a higher elevation than the point at which the water was collected and/or an inlet fluid level.

BACKGROUND OF THE INVENTION

The present invention is in the technical field of drainage. More particularly, the present invention pertains to seepage drainage and the removal of water by pumping, or a means other than gravitational drainage flow. The most common method to drain water that has been collected from seepage or surface flow is to grade pipe to a lower point. However, in many cases, e.g., particularly in land areas that are near sea level or with very flat property, there is no open airspace for the water to flow to that is lower than the water being collected. Or, if there is any open airspace, in many cases the open air space is such a long distance away that the installation of the drainage system becomes impractical.

Prior art alternatives to gravitational drainage include either siphoning the water to the nearest relief point (for example as discussed in U.S. Pat. No. 4,919,568, by the same inventor Dennis Hurley, which is hereby incorporated herein by reference), or pumping the water to the nearest relief point. A siphon is typically used when there is a lower airspace available, but it is a long distance away. It can be less expensive to siphon the water to the relief point than to take the water there by running pipe on grade. Siphons also are preferable to gravity systems when the relief point is so far away from the collection point that self-cleaning velocity cannot be achieved with gravity pipe.

If there is no lower airspace, the only known option in the prior art is to pump the water out of the area. If the water is pumped, the pump must pump the water to a higher elevation. The cost to run electrical service or to use solar panels to the pump site can be expensive. Prior art pumps that are used to pump water when there is no lower air space include centrifugal, submersible, or screw type pumps, which are described in the "Water Lifting Devices" publication, which is hereby incorporated herein by reference thereto and which was filed in U.S. Provisional Patent Application Ser. No. 62/617,917, on 16 Jan. 2018. In general, these prior art pumps are referred to herein as standard pumps or as fluid pumps. In general, a fluid pump is a device wherein the fluid that is being pumped passes through the internal workings of the pump that is used.

Some prior art land drainage systems include a vacuum pump in combination with a standard or fluid pump, e.g., in combination with a centrifugal, submersible, or screw pump of some type. The vacuum pump can be used for varying reasons, such as priming a fluid pump or keeping air out of a system that is reducing the efficiency of the pump. But, none of these systems can operate without the fluid pump component. U.S. Pat. No. 1,345,655, for example, references a screw pump and a vacuum pump in combination with an axial flow pump.

A pump sold under the trademark Gould 3888D3—WS D3 Series Sewage Pumps is a typical pump that is commonly used by utility contractors, golf courses and the like. These pumps when combined with floats, check valves and control panels are used to pump water.

However, they require large electrical services to run.

A pump sold under the trademark DuraMax (e.g., a DuroMax XP652WP 2-Inch Intake 7 HP OHV 4-Cycle 158-Gallon-Per-Minute Gas-Powered Portable Water Pump) is another pump that is commonly used by utility contractors, golf courses and the like. These pumps are heavy, and notorious for being difficult to prime, as well as being affected by the mud.

Other prior art systems utilize a vacuum pump for the purpose of what is commonly called vacuum enhanced drainage. This is a method whereby the system tries to accelerate the flow of water downward through the soil by creating a negative pressure in the drainage layer, or in pipe below a growing medium. This method is sometimes found to be useful when removing water that is held at the point where water is on the border of gravitational and capillary water. Such a system is typically used with athletic fields, golf greens, or other places where removing rainwater as quickly as possible is the primary objective. In these systems, however, the vacuum pump is being used to assist the water to flow downhill and is not being used to elevate the water. Some of these systems may also use a fluid or standard pump or elevate the water.

As mentioned, some prior art systems utilize siphons in land drainage. In siphon systems, water never exits the system at an elevation above a water collection level or an inlet fluid level.

In other prior art systems, sometimes a vacuum pump is included to perform a desired function, e.g., in testing procedures, or sewerage and wastewater applications, but no known land drainage system or method uses a vacuum pump to lift or elevate water, enabling the water to exit the system above a water collection level or inlet fluid level.

There is a need in art for a land drainage system that can collect water at a collection site at an inlet fluid level and exit the water at an elevation that is above the collection site and inlet fluid level without the use of standard or fluid pumps.

The following US patent documents are hereby incorporated herein by reference thereto.

| U.S. PAT. NO. | TITLE | ISSUE/ PUBLICATION DATE |
|---|---|---|
| 1,345,655 | SCREW PUMP | Jul. 6, 1920 |
| 3,788,544 | AGRICULTURAL IRRIGATION SYSTEM | Jan. 29, 1974 |
| 3,908,385 | PLANTED SURFACE CONDITIONING SYSTEM | Sep. 30, 1975 |
| 4,348,135 | DRAINING, IRRIGATING AND AERATION OF SOIL AND HEATING OR COOLING OF SOIL | Sep. 7, 1982 |
| 4,704,047 | LAND DRAINAGE SYSTEM | Nov. 3, 1987 |
| 4,717,284 | DEVICE FOR DRAINING SOILS IN DEPTH | Jan. 5, 1988 |
| 4,988,235 | SYSTEM FOR DRAINING LAND AREAS THROUGH SIPHONING FROM A PERMEABLE CATCH BASIN | Jan. 29, 1991 |
| 4,919,568 | SYSTEM FOR DRAINING LAND AREAS THROUGH SIPHONING FROM A PERMEABLE CATCH BASIN | Apr. 24, 1990 |
| 4,927,292 | HORIZONTAL DWATERING SYSTEM | May 22, 1990 |
| 5,120,157 | TENNIS COURT IRRIGATION | Jun. 9, 1992 |
| 5,219,243 | METHOD AND APPARATUS FOR THE HYDROLOGIC REGULATION OF TURF SOIL PROFILES | Jun. 15, 1993 |
| 5,350,251 | PLANTED SURFACE MOISTURE CONTROL SYSTEM | Sep. 27, 1994 |
| 5,590,980 | PLANTED SURFACE MOISTURE CONTROL SYSTEM | Jan. 7, 1997 |
| 5,752,784 | LOW PROFILE DRAINAGE NETWORK FOR ATHLETIC FIELD DRAINAGE SYSTEM | May 19, 1998 |
| 5,848,856 | SUBSURFACE FLUID DRAINAGE STORAGE SYSTEMS | Dec. 15, 1998 |
| 5,944,444 | CONTROL SYSTEM FOR DRAINING IRRIGATING AND HEATING AN ATHLETIC FIELD | Aug. 31, 1999 |
| 6,095,718 | SUBSURFACE FLUID DRAINAGE AND STORAGE SYSTEMS | Aug. 1, 2000 |
| 6,990,993 | VACUUM DRAINAGE SYSTEM | Jan. 31, 2006 |
| 7,172,366 | GOLF COURSE ENVIRONMENTAL MANAGEMENT SYSTEM AND METHOD | Feb. 6, 2007 |
| 7,413,380 | GOLF COURSE TURF CONDITIONING CONTROL SYSTEM AND METHOD | Aug. 19, 2009 |
| 2009/0056418 | METHOD AND SYSTEM FOR GROUNDWATER CONTAMINANT MONITORING | Mar. 5, 2000 |

SUMMARY OF THE INVENTION

The present invention solves problems in the prior art in a simple and straightforward manner. In one or more preferred embodiments, the apparatus, system and method of the present invention can be used for draining land areas, such as golf courses, farms, highways, and/or homes or residential areas, through the collection of drainage or seepage water into a principal catch basin that is positioned below an earth surface and lifting or pumping the drainage water out to another location through use of a vacuum pump or regenerative blower. A vacuum pump or regenerative blower is utilized to create a vacuum in tubing, piping, or a flow line, that extends from the catch basin to a vacuum collection chamber that is at a higher elevation than the catch basin, and wherein the vacuum causes a rise in the water column through the force of atmospheric pressure. Level controls, e.g., a switch, can be used to determine when the system should be activated and deactivated, and use a solenoid to break the vacuum when the piping is full so as to then allow gravity drainage of water that has been collected to a location that is at a higher elevation than the elevation at which the water was collected (or the elevation at which is sometimes described herein as the inlet fluid level).

The system, method and apparatus of the present invention can also easily be applied in many other areas or applications where lifting of water is required or desired such as, in irrigation systems where water needs to be lifted from a creek up to an irrigation pond, with boats where water needs to be pumped or lifted out, or with many other applications in which it is desirable or necessary to lift water above a water collection or fluid inlet level without also using a standard or fluid pump, and/or where gravity flow drainage is not possible, or is impractical, or is otherwise not desired from the primary collection basin.

In one or more preferred embodiments of the apparatus, system and method of the present invention, a primary catch basin that can collect both surface and seepage water is provided, which is positioned a desired distance below an earth surface or land surface. The primary catch basin preferably includes an uptake flow line, e.g., an uptake pipe or other tubing, and a level sensor. The level sensor can be set or programmed so that, when water has accumulated to a pre-set level in the primary catch basin, the system will be activated for removal of the collected water. The uptake flow line or pipe in the primary catch basin preferably has a one-way check valve, which allows water to flow from the primary catch basin into the uptake flow line or pipe, but not to flow back from the uptake flow line or pipe into the primary catch basin.

The primary catch basin is in communication with another collection chamber, which is sometimes referred to herein as a vacuum chamber or a vacuum collection chamber, which is preferably positioned at an apex (a highest elevation level) between the primary catch basin and an exit or exit point. The uptake flow line or piping can extend from the primary catch basin to the vacuum chamber, enabling fluid communication between the primary catch basin and the vacuum chamber.

The vacuum collection chamber is preferably placed below the earth surface (e.g., 2 to 30 feet below the earth surface) and preferably below a dry box that preferably houses a second level sensor and a switch, and a solenoid valve. In other embodiments, the vacuum chamber can be at or about even with the dry box or above the dry box. The vacuum collection chamber and dry box are preferably in communication with a remote control panel and a vacuum pump or regenerative blower via one or more flow lines, tubing, hosing, piping, and/or electrical lines, and/or remote communication such as radio waves.

The dry box is also preferably below the earth surface, e.g., 10 to 12 inches below the earth surface. A dry box top surface and/or access door can be at or level with an earth surface or, if desired, above an earth surface. The vacuum chamber is preferably directly below the dry box. A dry box is a housing, or a sealed valve box, that is preferably air tight so that water, dirt, debris, etc. cannot enter the dry box when closed. A dry box can be of any desired shape that is suitable to house a level sensor and switch. The dry box preferably is easily accessible from the earth surface, even if the dry box is completely below the earth surface.

At a remote location, a vacuum pump or a regenerative blower can be powered by a solar panel and/or a battery bank (e.g., a battery bank that is trickle charged from a low voltage AC supply, such as is available from irrigation controllers on golf courses and athletic fields), and/or by an AC power supply such as 110v, 220v, etc. The vacuum pump and regenerative blower can also be powered by other suitable means as are known in the art.

The control panel, which is preferably at a remote location, preferably is adapted to monitor the level sensor at the primary catch basin and to turn the vacuum pump or regenerative blower on based on the catch basin level sensor reading. The control panel at the remote location preferably is also adapted to turn the vacuum pump or regenerative blower off when the level sensor in the dry box indicates that water is entering an air hose, tubing or other line that leads to the vacuum pump or regenerative blower.

In addition, the control panel preferably houses a time delay relay. Preferably, a time delay relay can be adjusted to the exact amount of time that is required for the water to flow from the vacuum chamber at the apex to the exit for the system. This time can vary for each installation and can be calculated based on flow formulas. Adjusting the time that the vacuum pump or regenerative blower is off and the solenoid is open, and allowing the water to flow out of the vacuum collection chamber by gravity, is important because if the vacuum pump or regenerative blower is off longer than the necessary time for the water to flow out, this reduces the effective flow rate of the vacuum pump or regenerative blower.

In general, the effective flow rate of a pump is determined by three factors. The pumps capacity when operating; the amount of minutes the pump can operate before filling up the available space; and the discharge size of the outflow or outfall pipe. For example, a system that has enough storage volume in the vacuum chamber and the outflow or outfall pipe such that the vacuum pump or regenerative blower pump can operate for five (5) minutes without causing the sensor in the dry box and/or at the top of the vacuum chamber to shut the pump down, will have a higher effective flow rate than a system that has the same vacuum pump or regenerative blower that only operates for thirty (30) seconds before the vacuum pump or regenerative blower has to be shut down, allowing for flow of the water out from the apex. One must calculate the storage space that is contained in the system as well as how the time to gravity flow the system is affected by the outflow or outfall pipe diameter—the larger the diameter of the outflow or outfall pipe, the shorter the gravity flow time and the higher the effective flow rate of the vacuum pump or regenerative blower. The following formulas can be used in combination with the manufacturers specifications on a vacuum pump or regenerative blower to determine the effective flow rates of a system.

Storage Capacity: $V=0.785\times D^2\times L$, where V is the storage capacity in cubic feet. D is the diameter of the pipe in ft, L is the pipe length in ft Flow rate through a given pipe:

$$36.4\sqrt{\left(\left(\frac{H}{L}\times D\right)^5\right)}$$

Below is an example calculation.

| SIPHON FORMULA<br>36.4 SQRT H/L * D ^ 5 | | |
|---|---|---|
| HEAD 4 | LENGTH 300 | DIAMETER 6 |
| CU. FT/SEC | 0.743011889 | 36.4 = SQRT((2/200) * (1/12) ^ 5 |
| G/SEC | 5.557728927 | 0.0072971 |
| G/MIN | 333.4637356 | 0.7430119 |

H = DIFF HEIGHT
L = LENGTH
D = DIAMETER

In a test unit installed that has a vacuum pump and 2-inch diameter outflow or outfall piping, the flow rate was about thirty-five (35) gallons per minute. The vacuum collection chamber filled in about thirty (30) seconds with about seventeen (17) to eighteen (18) gallons of water. After the vacuum break, it took about thirty (30) seconds for the water in the vacuum chamber to drain to the exit. This makes the effective flow rate of the system approximately 17.5 GPM (Gallons Per Minute).

In general, the flow rate can be increased in two ways without having to increase the pump size. The vacuum chamber or outflow or outfall pipe can be lengthened, or the outflow or outfall pipe diameter can be increased. Either of these methods will increase the storage capacity, thus lengthening the time that the vacuum pump will pump, before having to evacuate the system. In the example given above, four (4) inch pipe would evacuate thirty-five (35) gallons in six (6) seconds as opposed to thirty (30) seconds for two (2) inch pipe. This increased pipe diameter alone would increase the effective pumping rate to 31.5 GPM, as the pump would be able to pump about 90% (or about 54 seconds) of a minute. However, the benefit of combining the increased diameter for storage along with the increased flow rate of the outflow or outfall pipe is that the effective flow rate would be even higher.

In various embodiments of the apparatus, system and/or method, a time delay relay can be used to adjust to each individual system.

In various embodiments of the apparatus, system and/or method, 2" to 4" outflow or outfall piping can be used.

In various embodiments of the apparatus, system and/or method, outflow or outfall piping of any desired size can be used.

The piping that goes from the vacuum chamber to the exit also preferably has a one-way check valve at an exit point. This valve can be placed below a water filled exit cylinder and can be held closed by the vacuum that is created inside of the piping. This water filled exit cylinder can assist the sealing of this one-way check valve, so that air does not seep past the valve.

At a remote location, a control panel in an enclosure can read the sensors, turn the vacuum pump or regenerative blower on and off, and open the solenoid valve at the proper times. When the sensor in the basin indicates that water should be removed, the panel is adapted to receive a signal from the sensor in the basin and to turn the vacuum pump or regenerative blower on to remove air from the vacuum chamber and the outlet piping that connects the vacuum chamber to the exit. The removal of this air creates a vacuum, and the atmospheric pressure that is pushing down on the water in the basin will force the water up into the intake piping, which can flow into the vacuum chamber and outflow or outfall piping depending on the quantity of water in the collection chamber. When the water level in the catch basin is down enough so that it reaches a pre-set off level in the basin, the level sensor will send a signal to the control panel to stop the vacuum pump or regenerative blower from pumping so that the vacuum will not be broken by sucking air into the uptake pipe. At the same time that the control panel stops the vacuum pump or regenerative blower, it sends a signal for the solenoid valve in the dry box to open. The opening of this solenoid breaks the vacuum and causes the water to flow out through the exit. When this happens the flow of water opens the one-way check valve at the exit and allows the water to rush out by gravity. At the same time, the water closes the one-way check valve at the bottom of the uptake pipe in the basin. This stops the water from flowing back into the basin, in order that the water does not have to be pumped again.

Should the water entering the basin come into the basin at a rate that is faster than the vacuum pump or regenerative blower can remove air from the system, for a long enough period of time that all of the storage space in the uptake pipe, the vacuum chamber and the outflow or outfall pipe is removed, then the water would rise above the vacuum chamber and start to enter the air hose that leads to the vacuum pump or regenerative blower. This will cause the level sensor that is in the dry box above the vacuum chamber to send a signal to stop the vacuum pump or regenerative blower from removing additional air, so as to prevent water from entering the vacuum pump or regenerative blower. The control panel stops the vacuum pump or regenerative blower; it sends a signal for the solenoid valve in the dry box to open. The opening of this solenoid breaks the vacuum and causes the water collected in the vacuum collection chamber and outflow or outfall pipe to flow out through the exit point. When this happens the flow of water opens the one-way check valve at the exit point and allows the water to rush out of the exit by gravity. At the same time, the water closes the one-way check valve at the bottom of the uptake pipe in the basin. This stops water that may remain in the uptake flow line or piping from flowing back into the basin, in order that it doesn't have to be pumped out again. The water can remain in the uptake flow line or piping all of the way up to an entrance of the vacuum chamber. But, all of the water from the vacuum chamber and the outflow piping that is connected to the exit will flow out of the exit by gravity flow. The solenoid preferably can be set to remain open for the amount of time that is required for this water to drain out. This time will vary depending on the size of the vacuum chamber that has been built, and the distance from the vacuum chamber to the exit point. After that predetermined time has been reached, the solenoid will close and the vacuum pump or regenerative blower will turn on if water in the catch basin has reached the pre-set on level in the basin, as can be read by the level sensor. Thus, the entire cycle will start again.

The present invention can include a system of draining a land area of excess water, comprising:

a drainage basin that collects surface and seepage water and includes an uptake line, pipe, hose or tube with a one-way check valve and a level sensor;

piping, tubing, hosing, or a line(s) that connects the drainage basin to a vacuum chamber that is placed at an apex point between the basin and an exit or exit point;

a vacuum chamber that is preferably placed directly below a dry box that houses another level sensor that detects if water is entering a connecting hose, tubing, piping or line that connects the vacuum chamber to a vacuum pump or a regenerative blower;

a location, which can be a remote location, that includes a vacuum pump or regenerative blower, a control panel, and a power source, e.g., solar panel and/or battery bank (e.g., battery bank that is trickle charge by a low voltage AC supply), and/or AC power such as 110v or 220v that does not require a battery bank;

an exit or exit point that has a one-way check valve placed below a water filled exit cylinder that closes when the vacuum pump or regenerative blower is pulling a vacuum, stopping air from entering through the relief or exit point;

wherein the exit or exit point is located at an elevation above the elevation of the drainage basin, but below the apex where the vacuum chamber is located;

the vacuum pump or regenerative blower operable to start pulling a vacuum on the vacuum chamber, as well as on the piping, hosing, tubing or lines that connect to and from the vacuum chamber when water is detected in the drainage basin at a predetermined level;

wherein the pulling of the vacuum causes water to flow through the one-way check valve in the uptake line, pipe, hose or tube at the basin via atmospheric pressure;

wherein the pulling of the vacuum causes the one-way check valve at the exit or exit point to close, so that no air can enter at the exit or exit point;

wherein the water in the water filled exit cylinder above the one-way check valve at the exit or exit point helps to seal the valve and not allow air to enter the system at the exit or exit point;

wherein the vacuum pump or regenerative blower is operable to cease pumping if the sensor in the basin indicates that the basin is about to run out of water and/or has reached a pre-determined off level, for example, wherein the level sensor in the basin can send a signal when the water in the basin has been removed to a point that is just above the bottom of the uptake pipe, e.g., 2 to 3 inches above the bottom of the uptake pipe, which causes the vacuum pump or regenerative blower to stop pumping, and at the same time causing the solenoid at the top of the vacuum chamber to open, which breaks the vacuum causing any the water collected in the vacuum chamber and outflow or outfall pipe, line, hose or tube to flow by gravity to the exit or exit point;

a sensor at the top of the vacuum chamber is adapted to detect when water has filled all of the piping and the vacuum chamber and the water is about to enter the line(s), tubing, hosing or piping that connects the vacuum chamber to the vacuum pump or regenerative blower;

wherein the sensor at the top of the vacuum chamber cause the vacuum pump or regenerative blower to stop pumping, and at the same time causes the solenoid at the top of the vacuum chamber to open, which breaks the vacuum causing the water to flow by gravity from the apex to the exit point;

an adjustable time delay relay, which can be set to the exact amount of time that it takes for the water to drain out of the vacuum chamber and the outflow or outfall pipe;

the opening of the solenoid valve breaks the vacuum, which then causes atmospheric pressure to make the water flow out, which causes the water to close the check valve on the uptake pipe;

the opening of the solenoid valve breaks the vacuum, which then causes atmospheric pressure to make the water flow out, which causes the water to open the check valve at the exit point or exit;

wherein the solenoid can be set to remain open for different lengths of time depending on how long it takes the water to drain from the vacuum chamber and the piping that is connected to the exit or exit point;

the length of time the solenoid will need to remain open will vary because large vacuum chambers and longer distances between the vacuum chamber and the exit or exit point will require differing amounts of time to fully drain out;

the solenoid will close after a predetermined time, and the panel will again start to monitor the basin to determine if water needs to be removed;

the entire cycle will start over, although this time the uptake pipe will already be filled with water, e.g., up to the inlet elevation of the vacuum chamber, because no water could flow from the apex to the basin, because of the closing of the one-way check valve at the bottom of the uptake pipe.

In one or more embodiments, the apparatus, system and/or method can include one or more auxiliary basins in addition to a primary catch basin/primary collection basin/primary drainage basin.

Auxiliary basins may be controlled without the need for any additional level sensors, e.g., other than the sensors in the primary catch basin and dry box, by constructing the elevation of the uptake pipe in each auxiliary basin to be as low as, or lower, than the elevation of the uptake pipe in the primary catch basin that has a level sensor.

In some embodiments, if desired, one or more auxiliary basins can include uptake piping, tubing, hosing or other lines that include a level sensor.

The one or more auxiliary basins can be controlled by the atmospheric pressure equalizing itself between all basins.

Auxiliary basins may be connected to the primary basin and/or vacuum chamber by either piping the uptake pipe from the auxiliary basins to the pipe coming from the primary basin, or by adding one or more additional connecting points to the vacuum chamber. Piping, hosing, tubing or other flow lines can be used to connect an auxiliary basin to the drainage system.

Preferably, an uptake pipe or other uptake line at each auxiliary basin will have a one-way check valve placed at or near a bottom of the uptake pipe or other line, in the same manner as the uptake pipe or other line in the primary catch basin. No other valving, other than the one-way check valve at the bottom of the uptake pipe or other line, will be required to add one or more auxiliary basins to the system.

The weight of a cubic foot of water is 62.43 pounds. The weight of a cubic foot of air is 0.0807 pounds (about 1.29 ounces). In various embodiments of the present invention, water is collected, e.g., via seepage or surface collection, in a collection basin installed below an earth surface, e.g., 2 to 30 feet below an earth surface. The present invention uses a vacuum pump or a regenerative blower to remove the air in piping and/or a vacuum chamber/container, and atmospheric pressure forces the collected water up into the vacuum chamber/container as a result of the vacuum that has been created. A control system allows the water to drain out by gravity to a point that is lower than the apex of the system (where the vacuum chamber/container is preferably located), but higher than the collection basin and/or an inlet fluid level. No water ever passes through the vacuum pump, such as happens with standard or fluid pumps. The system and method preferably is adapted to turn the vacuum pump or regenerative blower off before water can be drawn into the vacuum pump or regenerative blower. The vacuum pump or regenerative blower can use a solar panel, AC power, or can have a battery bank trickle charged from an auxiliary power source, such as a control panel on an irrigation system on a golf course.

In various embodiments the system can be powered electrically, pneumatically or hydraulically.

In various embodiments of the present invention the apparatus and/or component parts of the system can be fixed or portable. Portable devices can be automated, e.g., with use of a level sensor, or can be operated manually without the level sensors. In some embodiments a level sensor as well as a back-up manual system can be utilized.

In various embodiments of the apparatus, system and/or method that are being used to fill an irrigation pond from a stream, a level sensor can be placed in the pond, which can be adapted to activate a vacuum pump or regenerative blower when the level of the irrigation pond is down to a pre-set on level, and also adapted to turn off the vacuum pump or regenerative blower when the pond level is up to a pre-set off level.

Permanent systems can be installed entirely below ground or they can be placed above ground in situations such as commercial buildings or locations where installing the components below grade would cause disruption to utilities and/or dictate the removal of concrete, for example. The piping and vacuum chamber can be placed above ground and the piping can be mounted to a service wall like conduit.

In one or more preferred embodiments, the present invention includes a method of draining a land area of excess water, comprising the steps of:

providing a primary catch basin that is operable to collect water, e.g., via seepage or surface flow, the primary catch basin having an uptake pipe coupled thereto and a level sensor;

providing a vacuum chamber at an apex level, the vacuum chamber having a tank interior;

providing a primary fluid flow line allowing fluid flow from the catch basin uptake pipe to the vacuum chamber;

providing piping or a hose for communication between the vacuum chamber and the vacuum pump;

providing one or more auxiliary catch basins, each auxiliary catch basin in fluid communication, e.g., by a flow line, with either the primary fluid flow line or the vacuum chamber;

monitoring the water level of the primary catch basin, and wherein there is no need to monitor the water levels of the auxiliary catch basins;

subjecting the vacuum chamber interior and the connected piping or hose to a vacuum, creating a rise in atmospheric pressure that lifts that water from the primary catch basin to the vacuum chamber;

gravity draining water from the apex to the exit;

calculating the flow rate based on pump capacity, storage capacity and outflow or outfall pipe flow rate to set a time delay relay for the most efficient operation of the pump;

using a solenoid valve to create a vacuum break that allows water to flow by gravity from the apex to the exit; and using a conduit to provide adequate airflow from atmosphere into the sealed valve box.

In various embodiments of the system, apparatus and/or method, a two-way check valve can alternate opening and closing depending on whether the vacuum pump is operating or not.

In various embodiments of the system, apparatus and/or method, each uptake pipe has a check valve that disallows back flow from the flow line into the catch basin.

In various embodiments of the system, apparatus and/or method, one or more of the uptake pipes has a check valve that disallows back flow from the flow line into the catch basin.

In various embodiments of the system, apparatus and/or method, there are multiple flow lines, each connecting to the primary flow line or the vacuum chamber;

In various embodiments of the system, apparatus and/or method, a vacuum pump is used to draw a vacuum on said piping from the basin to the vacuum chamber, on the vacuum chamber itself and on the piping from the vacuum chamber to the exit point.

In various embodiments of the system, apparatus and/or method, a vacuum line connects the vacuum pump or regenerative blower to the vacuum chamber.

In various embodiments of the system, apparatus and/or method, a level sensor monitors the water level in the primary catch basin.

In various embodiments of the system, apparatus and/or method, a level sensor monitors the water level of a pond that is being filled. In this case, the vacuum pump or regenerative blower turns on when the water reaches a low point and shuts off when enough water is transferred to the pond, so that the high water level causes the upper sensor to stop the process.

In various embodiments of the system, apparatus and/or method, the system can be operated manually to remove water from a hole in a same or similar manner that portable pumps, e.g., a pump sold under the trademark DuraMax (e.g., a DuraMax XP652WP 2-Inch Intake 7 HP OHV 4-Cycle 158-Gallon-Per-Minute Gas-Powered Portable Water Pump) are used in construction. In such embodiments the vacuum pump or regenerative blower, uptake piping, vacuum chamber and outflow or outfall hose or pipe or line or tubing can be carried to a site and powered by the battery from any utility vehicle, for example, with the operator starting and stopping the vacuum pump or regenerative blower manually.

In various embodiments of the system, apparatus and/or method, a level sensor stops the vacuum pump or regenerative blower when water starts to enter the vacuum hose.

In various embodiments of the system, apparatus and/or method, a level sensor stops the vacuum pump or regenerative blower when water starts to enter a vacuum manifold that is in air communication with a vacuum hose and a vacuum chamber.

In various embodiments of the system, apparatus and/or method, a vacuum manifold is part of a vacuum chamber and a vacuum hose is in air communication with the vacuum manifold.

In various embodiments of the system, apparatus and/or method, a solenoid valve opens up at the same time the vacuum pump or regenerative blower stops in order to allow water to flow by gravity from the vacuum chamber to the exit or exit point or relief point or relief area.

In various embodiments of the system, apparatus and/or method, a time delay relay is used to adjust the amount of time that the solenoid valve is open, and the vacuum pump or regenerative blower is shut off, so that the vacuum pump or regenerative blower can be as efficient as possible.

In various embodiments of the system, apparatus and/or method, the apparatus or component parts of the system can be portable and operated manually.

In various embodiments of the system, apparatus and/or method, at some of the component parts of the system and apparatus can be placed above ground to reduce digging cost or the expense of digging under utilities. For example, the vacuum chamber and outfall piping can be placed above ground level or an earth surface.

In various embodiments of the system, apparatus and/or method, a control panel can be a printed circuit board, e.g., if desired to reduce the cost.

In one or more embodiments of the present invention, a method of draining a land area of excess water, comprises the steps of:

providing a catch basin for collecting fluid to be drained;

providing a vacuum chamber having a chamber interior, the vacuum chamber positioned at a level above the catch basin and in fluid communication with the catch basin;

subjecting the vacuum tank interior to a vacuum to pull air out of the chamber and lift water from the catch basin into the chamber; and gravity draining water from the vacuum chamber to an exit, wherein the exit is above a fluid level intake of the catch basin and below the vacuum chamber.

In various embodiments, the vacuum is created by a vacuum pump.

In various embodiments, the vacuum is created by a regenerative blower.

In various embodiments, there is further provided a second catch basin or an auxiliary catch basin.

In various embodiments, there is further provided multiple auxiliary catch basins.

In various embodiments, a time delay relay is included that allows water to flow for a time period equal to the time required to drain the water from the vacuum chamber to the exit.

In various embodiments, the water level of a primary catch basin is monitored, and auxiliary basins are controlled by the installation of the auxiliary basins to a depth greater than an elevation of an uptake pipe in the primary basin.

In various embodiments, the catch basin is coupled to the vacuum chamber by a flow line, or by multiple flow lines connected together prior to entering the vacuum chamber.

In various embodiments, water drains out of the vacuum chamber via gravity drainage.

In various embodiments, the catch basin has an interior with an uptake pipe that connects to a flow line in communication with the vacuum chamber.

In various embodiments, the uptake pipe has a check valve that disallows back flow from the flow line into the catch basin.

In various embodiments, a second basin, or each of the multiple auxiliary basins, includes an uptake pipe connecting to the flow line or to the vacuum chamber.

In various embodiments, a vacuum line connects the vacuum pump to the vacuum chamber.

In various embodiments, a level sensor monitors water level in the catch basin.

In one or more preferred embodiments, a land drainage system comprises:

a primary catch basin for collecting fluid to be drained;

fluid collected in the catch basin having an inlet fluid level;

a vacuum chamber having a vacuum chamber elevation;

an exit having an exit elevation;

a flow line operable to allow fluid flow from the primary catch basin to the vacuum chamber;

an exit line operable to allow fluid flow from the vacuum chamber to the exit;

wherein the water inlet level is below the vacuum chamber elevation, and wherein the exit elevation is located between the water inlet level and the vacuum chamber elevation;

a vacuum pump or a regenerative blower operable to pull a vacuum on the vacuum chamber which causes fluid collected in the primary catch basin to lift and flow to the vacuum chamber and/or into the exit line;

a valve operable to remain closed while pulling the vacuum on the vacuum chamber and operable to open to allow air flow to break the vacuum, enabling water collected in the vacuum chamber to drain to the exit line and out the exit via gravity.

In various embodiments, a level sensor is included in the catch basin which is operable to activate the vacuum pump or regenerative blower.

In various embodiments, an uptake pipe is in the catch basin that is coupled to the flow line, the uptake pipe including a check valve that prevents water from flowing back to the primary catch basin.

In various embodiments, the system further comprises an auxiliary basin.

In various embodiments, the system further comprises an auxiliary uptake pipe that is in fluid communication with the flow line or with the vacuum chamber.

In various embodiments, the auxiliary uptake pipe includes a check valve that prevents flow back to the auxiliary basin.

In various embodiments, the level sensor activates the vacuum pump or regenerative blower to lift water out of both the primary catch basin and auxiliary basin.

In various embodiments, the auxiliary uptake pipe is as low as or lower than an elevation of the uptake pipe in the primary catch basin.

In various embodiments, the auxiliary basin is controlled by atmospheric pressure equalizing between the primary catch basin and auxiliary basin.

In various embodiments, the system further comprises multiple auxiliary basins, wherein each auxiliary basin is controlled by atmospheric pressure equalizing between the primary catch basin and the multiple auxiliary basins.

In various embodiments, the system further comprises multiple auxiliary basins, wherein each auxiliary basin has an auxiliary uptake pipe that is as low as or lower than an elevation of the uptake pipe in the primary catch basin.

An example of a vacuum pump that can be used in one or more embodiments of the present invention, is a vacuum pump sold under the trademark Gast, which is commercially available at Grainger, or a vacuum pump sold under the trademark Airtech, Model HP200v 115v/AC, which is commercially available from the manufacturer.

An example of a regenerative blower that can be used in one or more embodiments of the present invention, is a regenerative blower sold under the trademark Airtech, Model #3ba1002-AB22, which is commercially available from the manufacturer.

An example of a level sensor that can be used in one or more embodiments of the present invention, e.g., in a primary catch basin and/or in a dry box and/or at the top of a vacuum chamber, is a level sensor sold under the trademark SMD Fluid Controls, which is custom made for Turf Drainage Company of America, part # FM11-1303-TUR1, which is commercially available at SMD Fluid Controls.

An example of a time delay relay that can be used in one or more preferred embodiments of the apparatus, system and method of the present invention is a time delay relay sold under the trademark IDEC, Model # RTE-P2D12, which is commercially available at OnlineComponents.com, or a time delay relay sold under the trademark Panasonic, which is commercially available at OnlineComponents.com.

An example of a switch that can be used in one or more preferred embodiments of the apparatus, system and method of the present invention is a solenoid valve sold under the trademark STC valve, 2P160-1/2-1D, which is commercially available from the manufacturer.

A primary catch basin that can be used in one or more preferred embodiments of the present invention can be sized to collect and hold 25 to 400 gallons of water or fluid but can be of any size depending on the application.

An auxiliary catch basin that can be used in one or more preferred embodiments of the present invention can be sized to collect and hold 25 to 400 gallons of water or fluid but can be of any size depending on the application.

In one or more preferred embodiments a vacuum collection chamber or vacuum chamber can be sized to hold 5 to 500 gallons of water or fluid, and preferably sized to hold 25 to 50 gallons of water or fluid.

In various embodiments, an exit can be a water filled exit cylinder.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
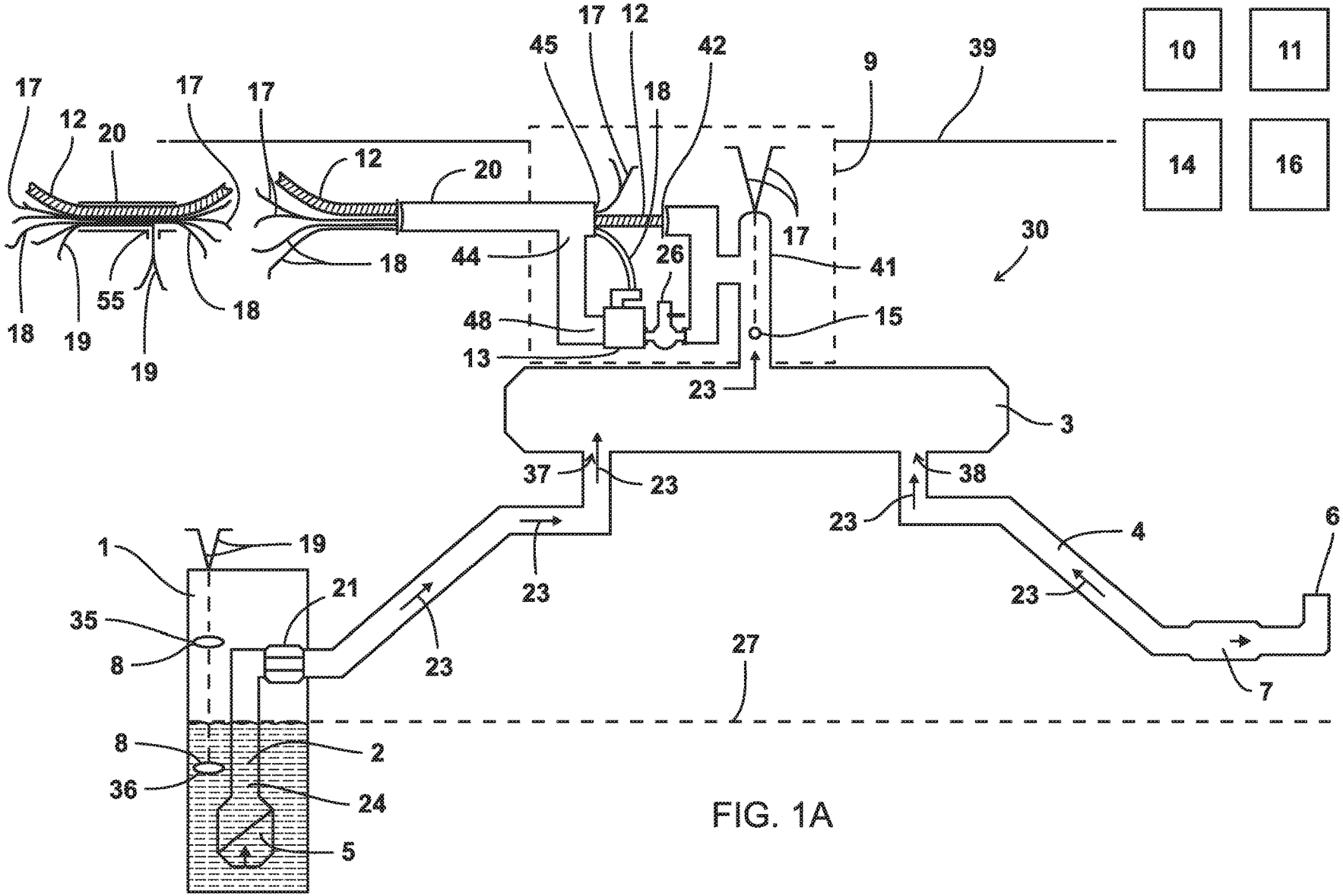
FIGS. 1A-1C are schematic diagrams and side views of a first preferred embodiment of a land drainage vacuum lift system of the present invention.
Figure 1B:
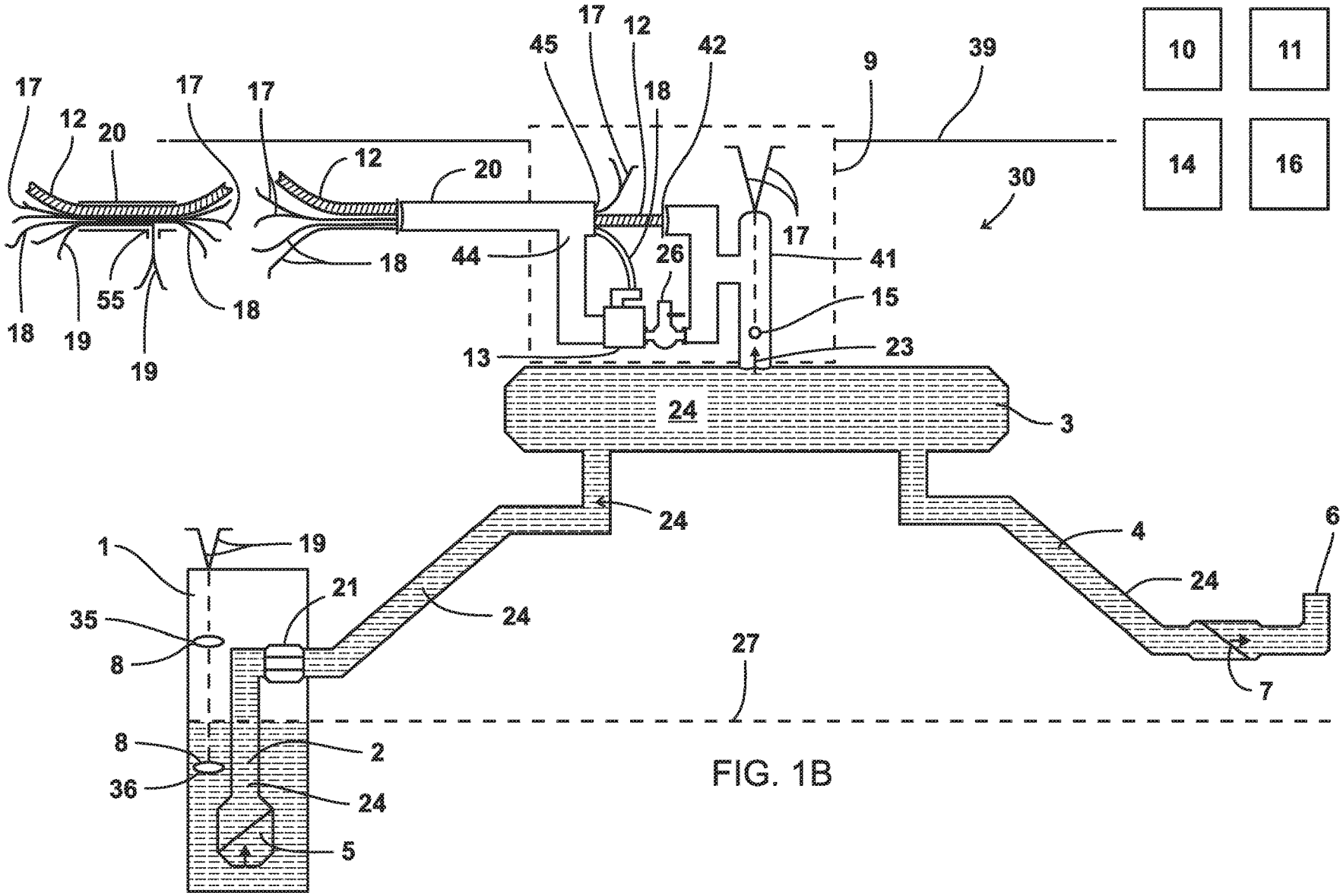
Figure 1C:
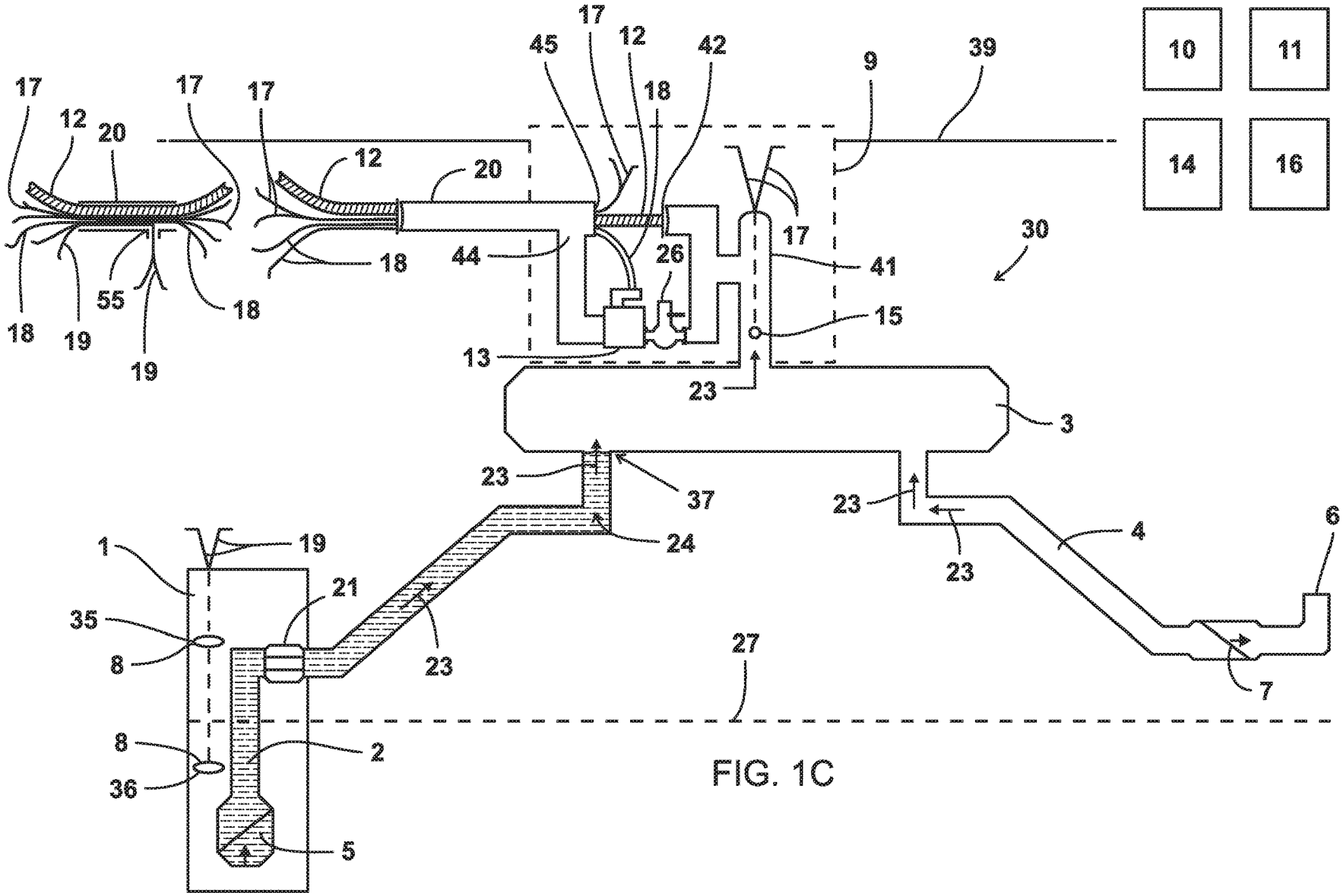
Figure 2A:
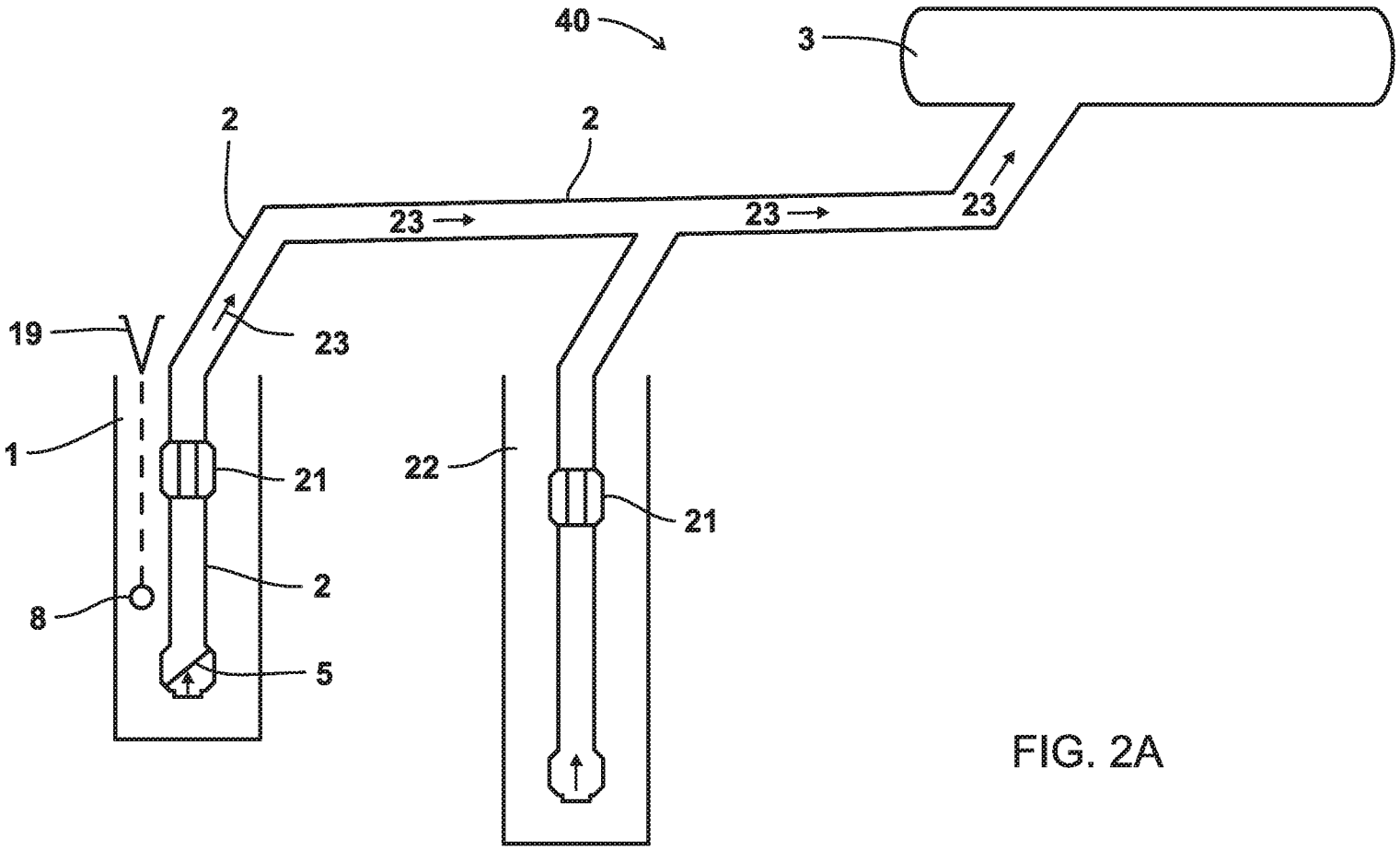
FIG. 2A is a partial side view of a second preferred embodiment of a land drainage vacuum lift system of the present invention including a primary catch basin and an auxiliary basin.
Figure 2B:
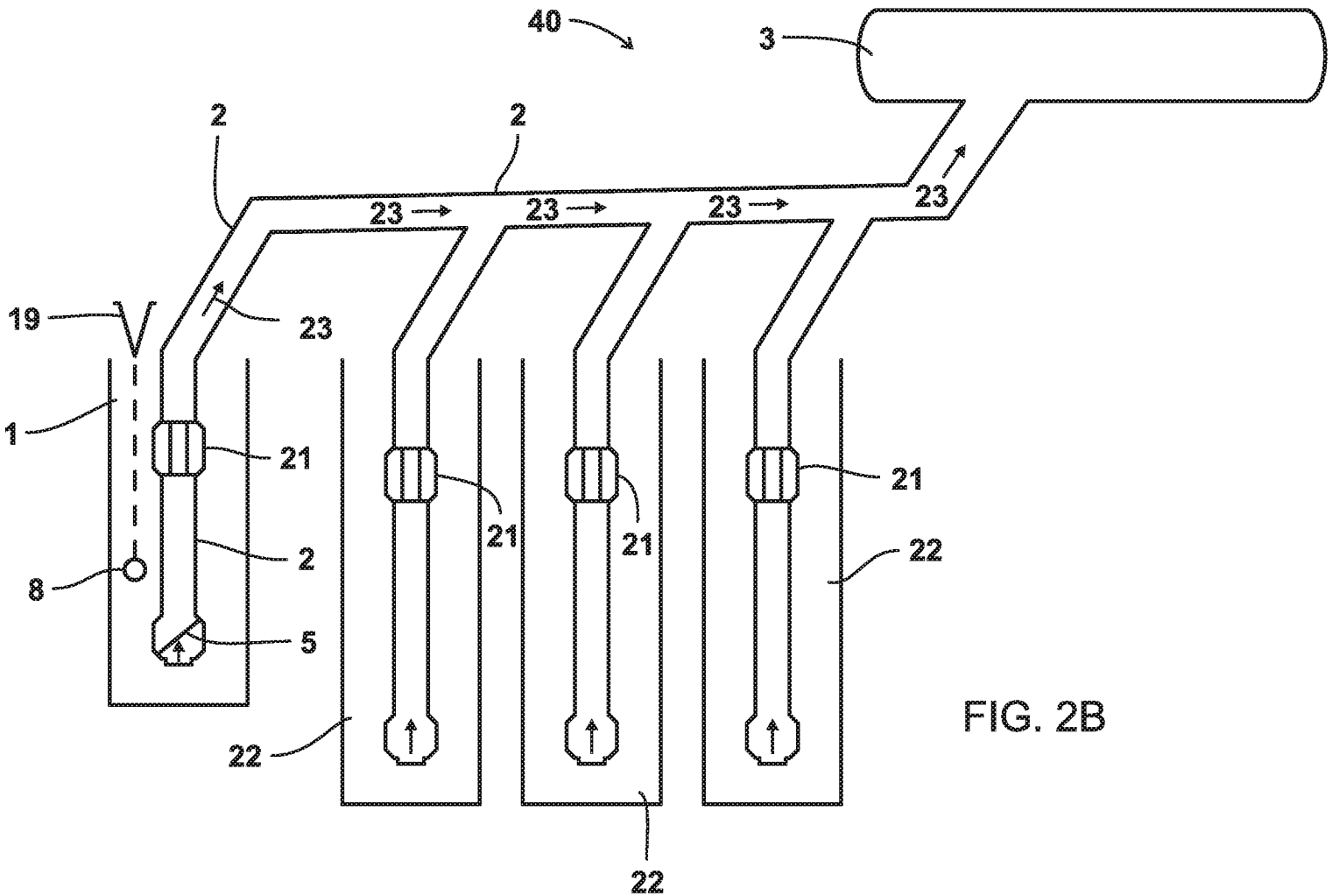
FIG. 2B is a partial side view of an alternative embodiment of the land drainage vacuum lift system as shown in FIG. 2A, including a primary catch basin and multiple auxiliary basins.

A first preferred embodiment of a land drainage system 30 of the present invention is illustrated in FIGS. 1A-1C. A collection basin 1 is installed below an earth surface at a desired depth, e.g., 2 to 30 feet below earth surface 39. In other embodiments, multiple catch basins can be utilized. FIG. 2A, for example, illustrates a partial view of a second preferred embodiment illustrating land drainage system 40 in which more than one catch basin is used. FIG. 2B illustrates an alternative preferred embodiment of system 40 in which more than two catch basins are included. Land drainage system 40 is described further below and can include similar component parts as the land drainage system 30 shown in FIGS. 1A-1C; however, the level sensor 8 is not required in the auxiliary basins 22. One or more auxiliary basins 22 can be added to land drainage system 40.

Referring to FIGS. 1A-1C, the system includes a collection basin 1 that can collect water 24, e.g., via seepage or surface flow or drainage. An uptake pipe 2 with a one way check valve 5 is in fluid communication with collection basin 1. Collection basin 1 is sometimes referred to herein as a primary catch basin. Uptake pipe 2 can be coupled to vacuum chamber 3, e.g., via a pipe fitting or union, and is in fluid communication with vacuum chamber 3. Uptake pipe 2 can also be coupled to one or more flow lines, e.g., via a union or pipe fitting, that are in fluid communication with vacuum chamber 3. Uptake pipe 2 preferably is a two (2) to four (4) inch diameter pipe, or a two (2) to four (4) inch tube, hose, or other suitable flow line can be used of any desired size, depending on the application. Vacuum chamber 3 can include an uptake pipe connector 33 for coupling to uptake pipe 2 and an outflow pipe connector 34 for coupling to outflow/outfall pipe 4.

Vacuum chamber 3 preferably is placed at the highest point for collection of water 24 (which is sometimes referred to herein as the apex) between collection basin 1 and an exit or exit point 6. Exit or exit point 6 may also be referred to herein as a relief point. Vacuum chamber 3 is coupled to, e.g., via a union or pipe fitting, and in fluid communication with, an outfall or outflow pipe 4 that ends at exit 6. Exit 6 as shown is preferably at an elevation that is higher than the bottom of uptake pipe 2.

Figure 8:
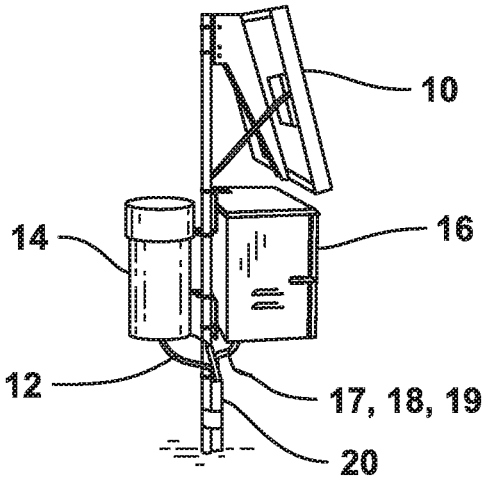
FIGS. 8-10 are perspective views illustrating a vacuum pump provided at different locations near a control panel, which arrangements can be included in the systems as shown in FIGS. 1A-2B.
Figure 9:
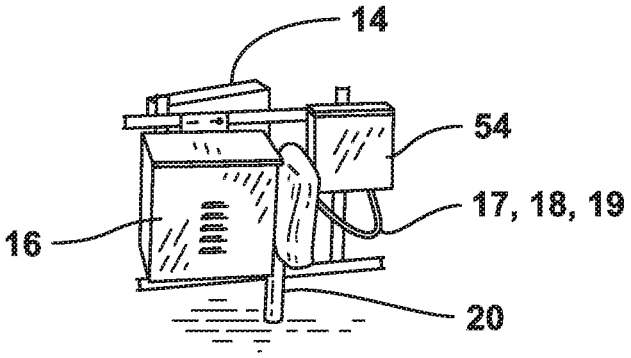
Figure 10:
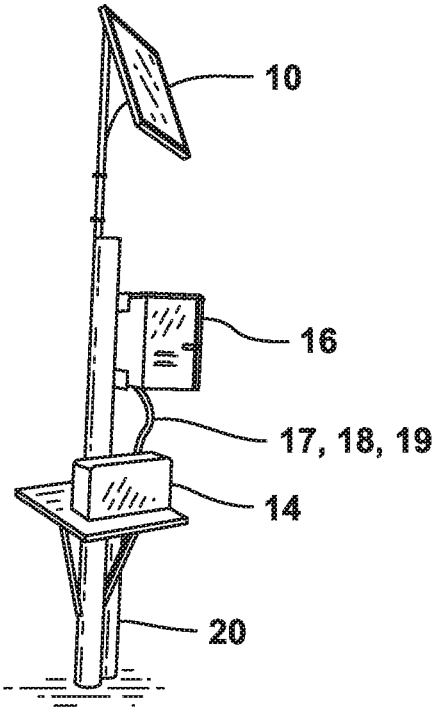

An exit 6 preferably has a check valve 7, which preferably is a one-way check valve, and a water filled exit cylinder, for example, each of which are described in U.S. Pat. No. 4,919,568, which is incorporated herein by reference in its entirety. Check valve 7 closes when vacuum pump 14 is activated, and operation of vacuum pump 14 causes a vacuum to be created inside of piping 2 and vacuum chamber 3. Vacuum chamber 3 can be connected to a remote vacuum pump 14 via a vacuum hose or line 12 (see FIGS. 1A-1C, 8, for example) or can be connected to a regenerative blower via a vacuum hose or line 12. Vacuum pump 14, or a regenerative blower, can be located inside a control panel 16, or outside of the control panel depending on the size of the vacuum pump or regenerative blower that is being used. FIGS. 8-10 illustrate possible locations for a vacuum pump 14 near a control panel 16. A regenerative blower can also be positioned at similar locations as shown. The location for a vacuum pump 14 or regenerative blower can be the nearest location to the vacuum chamber that is convenient, but it can be remotely located, e.g., for purpose of aesthetics. Vacuum pump 14 or a regenerative blower can be activated when water 24 in basin 1 rises to an on position 35, e.g., at the elevation/level of level sensor 8 at on level/position 35. In FIG. 9, an AC power supply 54 is shown in an embodiment that does not include a solar panel.

Vacuum chamber 3 preferably is positioned directly below dry box/valve box 9, which can house a level sensor 15 and a switch, e.g., a solenoid valve 13, for causing a break in a vacuum. A conduit 20 can extend from control panel 16 to dry box 9. Vacuum chamber 3 can be coupled to a vacuum manifold 41, e.g., via a pipe union or coupling. Vacuum manifold 41 can extend from vacuum chamber 3 and into dry box 9. A level sensor 15 can also be included in vacuum manifold 41 for detecting whether water has been drawn into vacuum manifold 41 towards vacuum hose 12. When vacuum pump 14 is turned on vacuum manifold 41, vacuum chamber 3, uptake pipe 2 and outflow/outfall pipe 4 will be under vacuum. It should be understood by those having ordinary skill in the art that manifold 41 can have other suitable configurations as desired.

Vacuum hose/line 12 can extend from control panel 16, housed by conduit 20, to dry box 9. Vacuum hose/line 12 can exit conduit 20 and tee fitting 46 at opening 45 and extend to vacuum manifold 41. A seal 42 can couple vacuum hose 12 to vacuum manifold 41 so that vacuum hose 12 can draw air from vacuum manifold 41, vacuum chamber 3, uptake pipe 2 and outflow/outfall pipe 4 and create a vacuum therein. Seal 42 can be a brass hose to PVC connection fitting, for example, or other suitable union or fitting that is commercially available.

After entering dry box 9, conduit 20 can be coupled to pipe spool 44 with a tee fitting 46. Pipe spool 44 can be coupled to pipe joint 48, which includes solenoid valve 13 and also a manual valve 26 (e.g., a gate or plug valve which is commercially available), via an elbow fitting 47. Pipe joint 48 can be coupled to vacuum manifold 41 via an elbow fitting 47.

Figure 4:
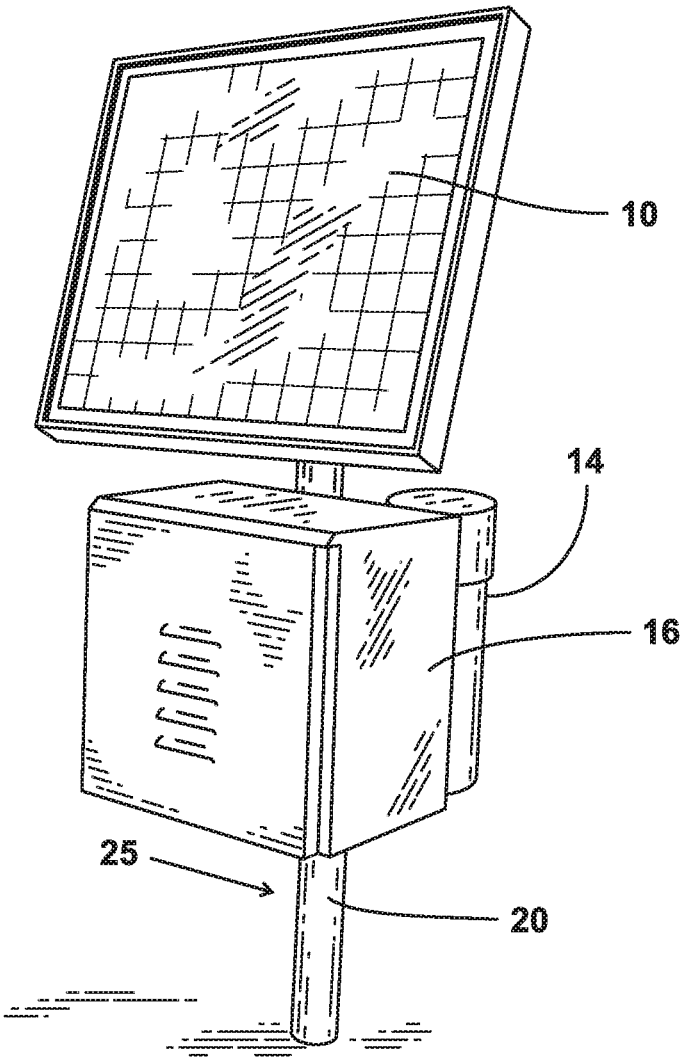
FIG. 4 is a perspective view of a solar panel and control panel enclosure that can be included in the embodiments as shown in FIGS. 1 and 2.

In one or more embodiments, the vacuum created by vacuum hose 12 can be broken by activating solenoid valve 13, and/or by manually opening manual valve 26. When solenoid valve 13 or manual valve 26 is open air that can enter the system at arrow 25 in FIG. 4 and/or at opening 45 as shown in FIG. 1A can then enter vacuum manifold 41 and break the vacuum.

In general, a vacuum pump can pull a higher vacuum than a regenerative blower. Current vacuum pumps can pull air about 20 to 33 feet. A vacuum pump is preferred for a system that will need to pull a higher vacuum or pull air to a higher apex, e.g., for a system with a primary catch basin that is installed more than 6 feet below an earth surface, or for a system that will need to pull air to a vacuum chamber or apex that is 6 feet above a fluid intake level.

A regenerative blower can be utilized in systems that will need to pull air about 6 feet or less. For example, a regenerative blower could be used in flood water applications for removal of flood waters to a remote location.

After being activated, vacuum pump 14, or a regenerative blower, pulls air out of uptake pipe/piping 2, vacuum chamber 3, and outflow or outfall pipe 4 in the direction of arrows 23 as shown in FIG. 1A, and water 24 that is in the collection basin 1 is lifted and can flow into uptake pipe/piping 2 by way of the atmospheric pressure. Vacuum pump 14, or a regenerative blower, will continue to draw or pull air in the direction of arrows 23 out of chamber 3, creating a stronger vacuum until either the level of water 24 reaches the off level/position 36 of sensor 8 in collection basin 1, or until water 24 is starting to enter pipe manifold 41 and moving towards vacuum hose/line 12. Vacuum hose 12 can end at seal 42 as shown. Seal 42 can be a brass hose to PVC connection fitting. Other suitable seals that are currently available or to be developed in the future can be used to couple vacuum hose 12 to manifold 41.

If water 24 either falls to the off level/position 36 of sensor 8 or rises above vacuum chamber 3 and activates level sensor 15, control panel 16 can send a signal that will stop operation of vacuum pump 14, or of a regenerative blower, and open a solenoid valve/solenoid 13. In some embodiments, control panel 16 can send a signal that will stop operation of vacuum pump 14, or of a regenerative blower, and open a switch. The opening of solenoid valve 13 causes a vacuum break by allowing air to enter pipe manifold 41 and the parts of the system that are under vacuum. This causes all of the water to flow from vacuum chamber 3 exit 38 and from outfall pipe 4 out through exit 6.

FIG. 1A shows catch basin 1 prior to any activation from liquid level sensors 8 or 15. In preferred embodiments in which a one-way check valve 5 is included in piping/uptake pipe 2, the only time that air should be in uptake pipe/piping 2 from the catch basin 1 to an entrance 37 of vacuum chamber 3 is prior to the system operating for the first time. In embodiments in which a check valve is not used in uptake pipe/piping 2, water that has already been lifted and collected in vacuum chamber 3 will be able to back flow into catch basin 1 and some air may then be present in uptake pipe/piping 2, which is not preferred as then the water will again have to be lifted out of catch basin 1.

FIG. 1B illustrates the system when all of the air has been pulled out from uptake pipe/piping 2, vacuum chamber 3 and outfall/outflow pipe 4 and water 24 has flowed out of catch basin 1, and has filled uptake pipe/piping 2, vacuum chamber 3 and outflow/outfall pipe 4 and is about to trigger level sensor 15 prior to water 24 entering manifold 41 towards vacuum hose/line 12, which leads to vacuum pump 14. FIG. 1C represents the system after solenoid valve 13 has opened and all of water 24 has drained from vacuum chamber 3 and the outflow or outfall pipe 4. Water 24 can still remain in the uptake pipe 2, as the one-way check valve 5 has closed and prevented this water from draining back into catch basin 1.

In some embodiments, solenoid valve 13 alternatively can come on/open only when vacuum chamber 3 is full of water and sensor 15 is activated, although preferably solenoid valve 13 will come on/open, and vacuum pump 14 or regenerative blower will be deactivated, every time that either level sensor 8 or level sensor 15 shuts off (or is in or at an off position/level) because this allows some of the drainage to occur when vacuum pump 14 or regenerative blower is off anyway, and the basin is filling with water. Allowing draining of the water when the vacuum pump 14 or regenerative blower would have been off anyway increases the effective flow rate of the vacuum pump 14 or regenerative blower.

An adjustable time delay relay 29 can be included in a system 30 and/or 40. Adjustable time delay relay 29 can keep solenoid valve 13 open and vacuum pump 14 off for the amount of time that is required for water 24 to flow from vacuum chamber 3 and outfall/outflow pipe 4 to exit 6. Each system, either a system 30 without auxiliary basins or a system 40 with auxiliary basins, can have a different length of time that can be adjusted to the exact amount of time that is required for water 24 to flow from vacuum chamber 3 at the apex (e.g., within vacuum chamber 3), and outfall/outflow pipe 4, to exit 6. This time period will be different for each installation/individual system and can be calculated based on flow formulas as discussed herein.

During the vacuum break, water 24 from at or about a bottom of vacuum chamber 3, or at or about entrance 37 to vacuum chamber 3, down to check valve 5 of uptake pipe/piping 2 is retained in uptake pipe/piping 2 by the closing of check valve 5. In this manner, water 24 will not flow back into catch basin 1 and will not have to be pumped out of catch basin 1 for a second time.

The controls of the circuitry in one or more preferred embodiments of the apparatus, system and method can be done electrically, pneumatically or hydraulically. If electrical circuitry is used, a control panel 16 as shown in FIGS. 4, 8-10, for example, can be used. Alternatively, a printed circuit board or microprocessor can be used. A printed circuit board can be custom made for the system in a manner as is currently known in the art or to be developed in the future.

Figure 5:
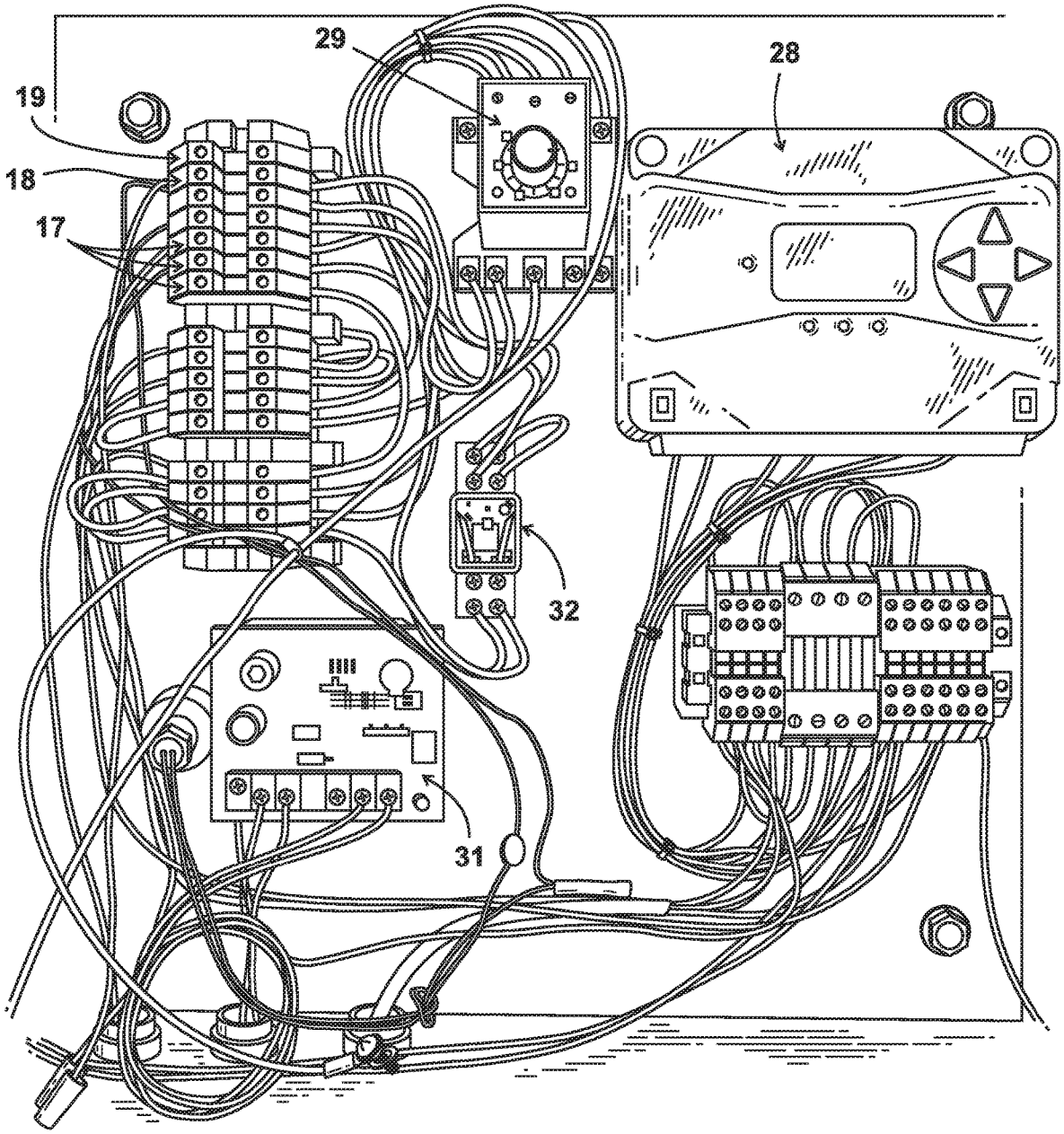
FIG. 5 is a perspective view of a control panel that can be included in the embodiments as shown in FIGS. 1 and 2.
Figure 6:
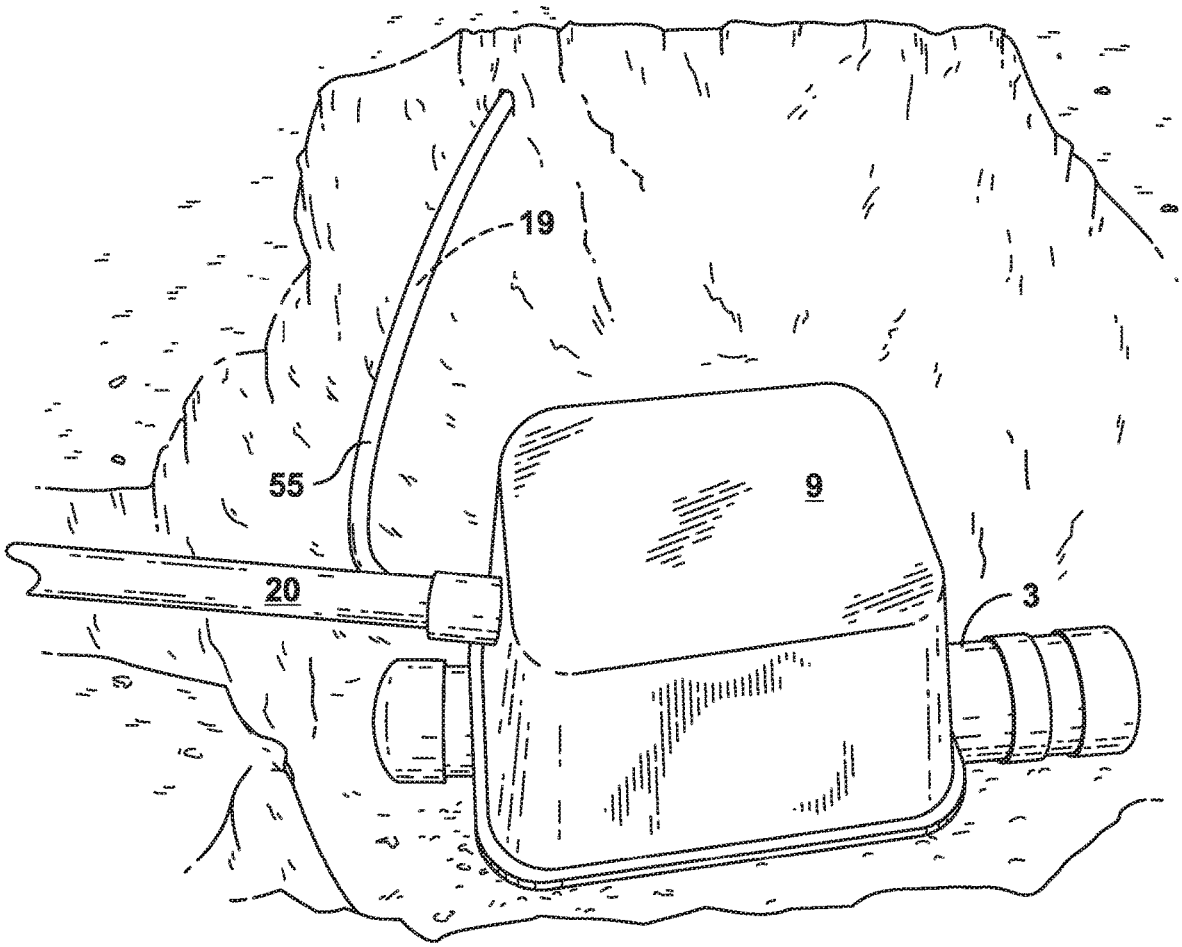
FIG. 6 is a top view of a dry box that can be included in the embodiments as shown in FIGS. 1 and 2.
Figure 7:
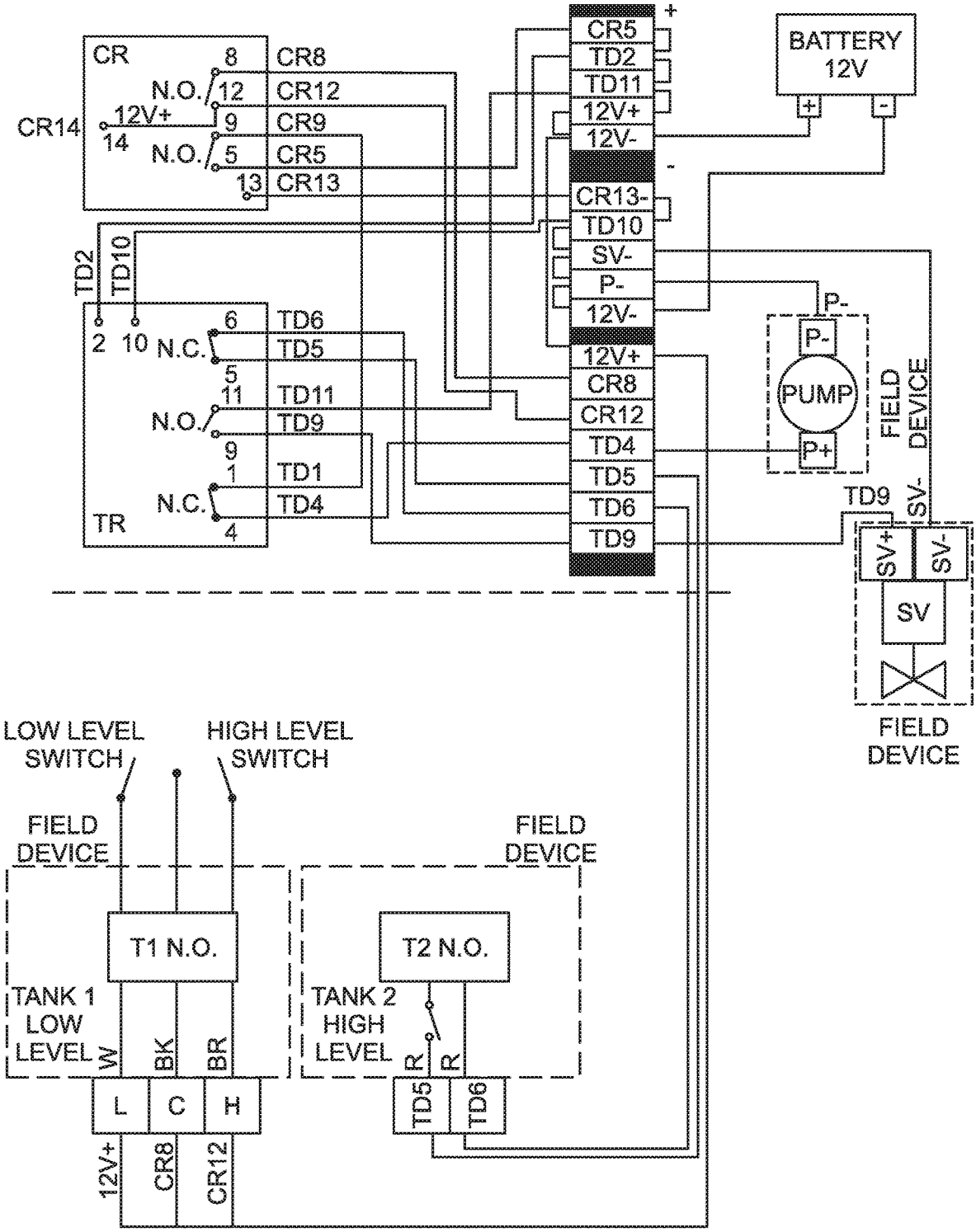
FIG. 7 illustrates electrical schematics for a control panel that you can be used in the systems as shown in FIGS. 1A and 2.

A control panel 16 for a land drainage system 30, 40 can be remotely located (see FIGS. 1A-1C, 4, 8-10). FIG. 5 illustrates an interior of control panel 16, which can include a charge controller 28, time delay relay 29, AC to DC converter 31 and control relay 32. Alternatively, a printed circuit board can be used as a control panel. A printed circuit board can be custom designed, in a manner that is currently known in the art or to be developed in the future, for this purpose and for providing power to and control of one or more preferred embodiments of the system as described herein.

There can be three wire systems coming from control panel 16 and in communication with land drainage system 30 or 40. One or more wires 19 can extend from control panel 16 to level sensor 8 in catch basin 1. Conduit 20 can house wires 19 extending from control panel 16. Wires 19 can exit conduit 20 at a desired location and extend out from a break/opening in conduit 20, e.g., at a location before conduit 20 reaches dry box 9, and then extend to level sensor 8 of catch basin 1 and energize and/or provide power to level sensor 8, in a manner as is known in the art. Wires 19 can exit conduit 20 and be housed by another conduit 55, extending to level sensor 8.

One or more wires 18 can extend from control panel 16 to solenoid 13 and energize and/or provide power to solenoid 13. Conduit 20 can house wires 18 extending from control panel 16 to dry box 9 and wires 18 can exit and extend out from conduit 20 and tee fitting 46 at opening/break 45 in conduit 20 within dry box 9 as shown in FIG. 1A, for example, and extend to solenoid valve 13 and energize and/or provide power to solenoid valve 13, within dry box 9.

Figure 3:
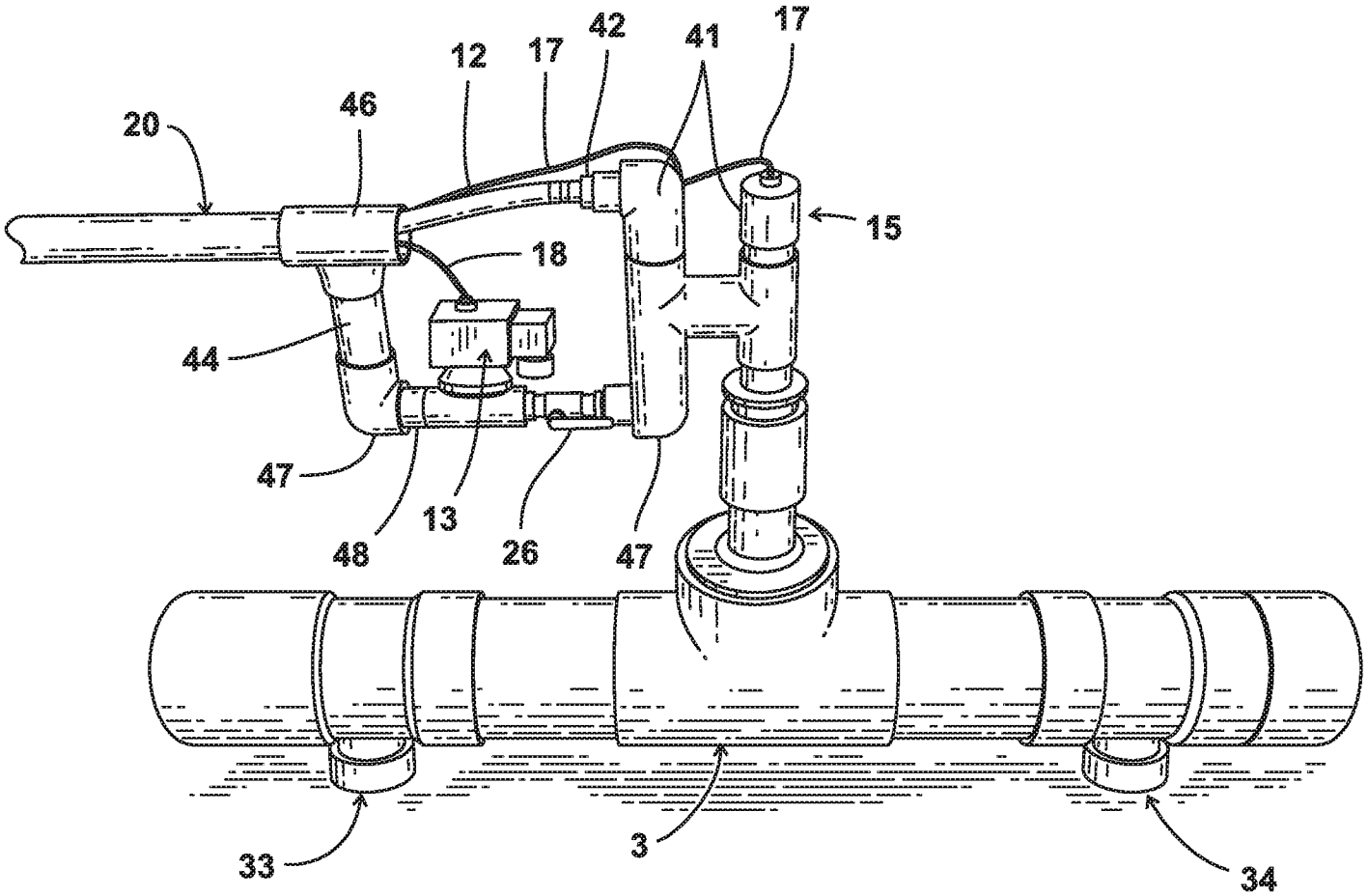
FIG. 3 is a perspective view of a vacuum chamber that can be included in the embodiments as shown in FIGS. 1 and 2.

One or more wires 17 can extend from control panel 16 to level sensor 15 and provide power to level sensor 15. Conduit 20 can house wires 17 and wires 17 can exit conduit 20 at a desired location, e.g., at opening 45, and extend directly to level sensor 15. Wires 17 can extend to and energize and/or provide power to sensor 15, e.g., as shown in FIGS. 1A and 3.

Vacuum chamber 3 can be placed preferably about 10 to 14 inches below an earth surface. Dry box 9 can also be placed within earthen material, with the top placed even with the earth surface 39, for easy access. Preferably dry box 9 can be easily accessed from earth surface 39.

Conduit 20 can extend from dry box 9 to control panel 16. Conduit 20 can house wires 17, 18, 19 and vacuum hose 12 and can allow air to flow from outside of dry box 9 to inside dry box 9 so that solenoid 13 can cause a break in the vacuum when solenoid 13 opens. Referring to FIGS. 1A-IC, 4, air can enter conduit 20 at opening 45 and also at arrow 25.

If an uptake pipe 2 needs to be replaced or serviced on a catch basin 1 or auxiliary basin 22, union 21 allows uptake pipe 2 to be serviced from the ground level. The location of union 21 can preferably be about 1 foot, for example, below an earth surface 39. A removable grate or other cover can be provided at or near earth surface 39 for access to union 21. A union 21 can be 1 foot below the earth surface in embodiments wherein a catch basin 1 or auxiliary basin 22 is positioned so that the grate is at the earth surface 39 but can extend 2 to 30 feet below the earth surface 39.

System 30, 40 may be energized by DC (Direct Current), AC (alternating Current), or a solar panel 10 in tandem with a battery bank 11. In further detail on FIGS. 1A-3, the apparatus could be made with piping of any size. For example, 2 to 4 inch diameter piping can be utilized. The lift that can be created can be limited to one atmosphere or lift of approximately 33 feet.

Component parts of a system 30 or 40, including piping 2 and outfall or outflow pipe 4 can be made of any suitable material, including plastic, PVC (Poly Vinyl Chloride), HDPE (High Density Polyethylene) or metal pipe.

Catch basin 1 can be either permeable, or a solid walled basin. If the only objective is to collect surface water, a solid walled basin will be adequate. If it is desired to also collect seepage water, for example, a permeable basin is preferred.

Advantages of the present invention include the ability to pump water 24 collected at an inlet fluid level 27, represented by a dashed line in FIGS. 1A-1C, to a higher elevation than the inlet fluid level 27 with less electricity than is currently needed with a standard or fluid pump, e.g., a submersible, screw or axial pump that has the water run through the pump. Using a vacuum pump 14 in combination with a permeable basin, for example, allows collection of deep seepage water inexpensively. One or more embodiments of the apparatus, system and method can be used on flat coastal properties, or to collect water from deep hillside springs, or to remove water from around foundations of buildings. Since the entire system can be serviceable from the surface, e.g., with one or more removable union 21, the component parts of the system can be installed, serviced, and replaced without getting down in the hole. This gives one the opportunity to build these units to great depths, such as 30 feet deep, into the ground, to remove the moving ground water and to stabilize hillsides, for example, without having to dig gravity pipe for relief on the water that is collected at these depths.

In comparison to a siphon, one or more embodiments of the system and method of the present invention has many advantages. A siphon is limited on coastal properties to only being able to drain to sea level. On these types of properties, multiple siphons are usually used to move water to one central pump site. Without the central pump site to create an airspace below sea level, the siphons are of limited use. With the present invention, the water can often be lifted to an existing pipe that was already in the ground. Even though that pipe may be above the elevation of the level at which it is now desired to collect the water. This existing pipe can be used because collected water is lifted in the system and method to the elevation of that pipe.

The alternative of using currently available sump pumps has limits also. A sump pump system can only pump from one location at a time. If a second site is to remove ground water at the same depth as the site that is being pumped, the second site must either be connected to the pump via a gravity line that must be installed and graded to the depth of the sump pump uptake, or a siphon must be used to bring water to the sump pump. One or more embodiments of the present invention are an improvement because multiple sites can operate off of a single vacuum pump or regenerative blower.

FIG. 2A illustrates a partial view of a second preferred embodiment illustrating land drainage system 40 in which a primary catch basin 1, and an auxiliary catch basin 22, are used. Land drainage system 40 can be the same or similar to a land drainage system 30 and include auxiliary catch basins 22 in addition to a primary catch basin 1. Multiple auxiliary catch basins 22, e.g., 2, 3, 4, 5, 6, 7, 8, 9, 10, or more auxiliary catch basins 22 as desired can be utilized. FIG. 2B illustrates a partial side view of an alternative embodiment of land drainage system 40 that includes a primary catch basin and multiple auxiliary basins. In the embodiments of FIGS. 2A and 2B, vacuum chamber 3 can be coupled to a vacuum hose 12 and/or to a pipe manifold 41 having a vacuum hose 12 coupled thereto and a level sensor 15, e.g., as shown in FIGS. 1A-1C and 3.

In FIGS. 2A-2B, primary catch basin 1, which contains a level sensor 8, is placed at an elevation as high as, or higher than, all other basins that will be part of the system. By placing auxiliary catch basin 22 at an elevation lower than the uptake pipe in the primary catch basin 1, the uptake pipes in the auxiliary catch basins 22 will always be under water and will never suck air that could break the vacuum. If multiple auxiliary basins are utilized, all auxiliary basins preferably are placed at an elevation lower than the uptake pipe of primary catch basin 1. These basins can all be added without having to add additional level sensors or wiring.

One of the disadvantages of standard or fluid pumps is that they can become clogged by debris that gets trapped in an impeller. In one or more embodiments of the present invention, contaminants in the water never pass through an opening smaller than the initial opening that the water enters at the uptake pipe 2. This allows much dirtier water to be transported with this system than with many types of standard or fluid pumps, e.g., submersible pumps.

In various embodiments, a land drainage system in accordance with one or more embodiments described herein can be manually operated or partially manually operated. A user having a utility cart can hook up the system, e.g., as shown in the figures, to a battery, and monitor the system so that water does not enter the vacuum hose. A sensor 15 could be built into the system, or the vacuum could be created and broken manually. When a vacuum chamber unit is nearly full, a valve could be manually opened to create the vacuum break.

In some embodiments, a control panel can wirelessly control a level sensor in a catch basin or in the vacuum manifold and/or a switch that is adapted to break a vacuum in the system, in a manner that is currently known in the art or as may be developed in the future.

While the foregoing written description of the invention enables one of ordinary skill to make and use that is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

PARTS LIST

The following is a list of parts and materials suitable for use in the present invention.

PARTS LIST
The following is a list of parts and materials suitable for use in the present invention.

| Parts Number | Description |
|---|---|
| 1 | collection basin/primary catch basin |
| 2 | uptake pipe/piping |
| 3 | vacuum chamber |
| 4 | outfall or outflow pipe, tube, line, or hose |
| 5 | one way check valve |
| 6 | exit or exit point/relief point |

-continued

PARTS LIST
The following is a list of parts and materials suitable for use in the present invention.

| Parts Number | Description |
|---|---|
| 7 | one-way check valve/check valve |
| 8 | level sensor |
| 9 | valve box/dry box |
| 10 | solar panel |
| 11 | battery bank |
| 12 | vacuum hose/line |
| 13 | solenoid valve/solenoid |
| 14 | vacuum pump |
| 15 | level sensor |
| 16 | control panel |
| 17 | wires to sensor 15/wires |
| 18 | wires to solenoid 13/wires |
| 19 | wires to sensor 8/wires |
| 20 | conduit |
| 21 | union |
| 22 | auxiliary basin/auxiliary catch basin |
| 23 | arrow |
| 24 | water |
| 25 | arrow - air in |
| 26 | manual valve |
| 27 | inlet fluid level |
| 28 | charge controller |
| 29 | time delay relay |
| 30 | land drainage system |
| 31 | AC to DC converter |
| 32 | control relay |
| 33 | uptake pipe connector |
| 34 | outflow pipe connector |
| 35 | on level/position |
| 36 | off level/position |
| 37 | entrance |
| 38 | exit |
| 39 | earth surface/land surface/ground surface |
| 40 | land drainage system |
| 41 | pipe manifold/vacuum manifold/manifold |
| 42 | seal |
| 44 | pipe spool |
| 45 | opening/break that supplies air for vacuum break to sealed dry box |
| 46 | tee fitting |
| 47 | elbow fitting |
| 48 | pipe joint |
| 54 | AC power supply |
| 55 | conduit |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of draining a land area of excess water, comprising the steps of:

a) providing a catch basin for collecting fluid to be drained;

b) providing a vacuum chamber having a chamber interior, the vacuum chamber positioned at a level above the catch basin and in fluid communication with the catch basin;

c) subjecting the vacuum chamber interior to a vacuum to pull air out of the vacuum chamber and lift water from the catch basin into the vacuum chamber; and d) breaking the vacuum and allowing water to drain from the vacuum chamber to an exit, wherein the exit is above a fluid level intake of the catch basin and below the vacuum chamber.

2. The method of claim 1 wherein in step (c) the vacuum is created by a vacuum pump or a regenerative blower.

3. The method of claim 1, further comprising providing a second catch basin.

4. The method of claim 2, further comprising providing a time delay relay that adjusts time that the vacuum pump or regenerative blower is off and no vacuum is present for allowing water to flow for a time period equal to a time required to drain the water from the vacuum chamber to the exit.

5. The method of claim 1 wherein in step (d) the water is gravity drained.

6. A land drainage system comprising:

a) a primary catch basin for collecting fluid to be drained;

b) fluid collected in the primary catch basin having an inlet fluid level;

c) a vacuum chamber having a vacuum chamber elevation;

d) an exit having an exit elevation that is higher than the fluid inlet level at the primary catch basin;

e) a flow line operable to allow fluid flow from the primary catch basin to the vacuum chamber;

f) an exit line operable to allow fluid flow from the vacuum chamber to the exit;

g) wherein the inlet fluid level is below the vacuum chamber elevation, and wherein the exit elevation is located between the inlet fluid level and the vacuum chamber elevation;

h) a vacuum pump or a regenerative blower operable to pull a vacuum on the vacuum chamber which causes fluid collected in the primary catch basin to lift and flow to the vacuum chamber and/or into the exit line; and i) a valve having a valving member movable between an open position and a closed position, wherein the valve in the closed position causes creation of a vacuum in the system wherein a vacuum is pulled on the vacuum chamber and wherein the valve in the open position enables air flow in the system which breaks the vacuum, enabling water collected in the vacuum chamber to drain to the exit line and out the exit via gravity; and wherein creating the vacuum and then breaking the vacuum enables the system to lift the fluid above the inlet fluid level and to drain the fluid without also having to use a standard pump or a fluid pump that requires fluid to pass through the pump.

7. The system in claim 6 wherein a level sensor is included in the primary catch basin which is operable to activate the vacuum pump or regenerative blower.

8. The system in claim 7 wherein a first uptake pipe is in the primary catch basin that is coupled to the flow line, the first uptake pipe including a check valve that prevents water from flowing back to the primary catch basin.

9. The system in claim 8 further comprising an auxiliary basin.

10. The system in claim 9 further comprising an auxiliary uptake pipe that is in fluid communication with the flow line or with the vacuum chamber.

11. The system in claim 10 wherein the auxiliary uptake pipe includes a check valve that prevents flow back to the auxiliary basin.

12. The system in claim 11 wherein the level sensor activates the vacuum pump or regenerative blower to lift water out of both the primary catch basin and auxiliary basin.

13. The system in claim 12 wherein the auxiliary uptake pipe is as low as or lower than an elevation of the uptake pipe in the primary catch basin.

14. The system in claim 13 wherein lifting water out of the auxiliary basin is controlled by atmospheric pressure equalizing between the primary catch basin and auxiliary basin.

15. The system of claim 14 further comprising multiple auxiliary basins, wherein lifting water out of each of the multiple auxiliary basins is controlled by atmospheric pressure equalizing between the primary catch basin and the multiple auxiliary basins.

16. The system of claim 14 further comprising multiple auxiliary basins, wherein each auxiliary basin has an auxiliary uptake pipe that is as low as or lower than an elevation of the uptake pipe in the primary catch basin.

17. The system of claim 6, wherein the system is adapted to be operated manually.

18. The system of claim 17, wherein the system is portable.

19. The system of claim 6, wherein the vacuum pump or regenerative blower is powered by a solar panel and/or a battery bank, and/or by an AC power supply.

20. The system of claim 6 wherein the vacuum chamber and exit are below a ground surface.

21. A method of draining a land area of excess water, comprising the steps of:

a) providing a catch basin for collecting fluid to be drained;

b) providing a vacuum chamber having a chamber interior, the vacuum chamber positioned at a level above the catch basin and in fluid communication with the catch basin via attached tubing;

c) creating a vacuum in the vacuum chamber and attached tubing which causes atmospheric pressure to push the fluid up into the vacuum chamber; and d) breaking the vacuum to allow gravity draining of fluid from the vacuum chamber to an exit, wherein the exit is above a fluid level intake of the catch basin and below the vacuum chamber.

* * * * *